US010563888B2

(12) United States Patent
DeMonte et al.

(10) Patent No.: US 10,563,888 B2
(45) Date of Patent: Feb. 18, 2020

(54) WATER RESERVOIR FOR A PORTABLE DEHUMIDIFIER

(71) Applicant: THERMA-STOR LLC, Madison, WI (US)

(72) Inventors: Todd R. DeMonte, Cottage Grove, WI (US); Steven S. Dingle, McFarland, WI (US); Joshua William Henry, Columbus, WI (US); James A. Scharping, Jr., Madison, WI (US); Jerome Verhoeven, Sun Prairie, WI (US)

(73) Assignee: Therma-Stor LLC, Madison, WI (US)

( * ) Notice: Subject to any disclaimer, the term of this patent is extended or adjusted under 35 U.S.C. 154(b) by 114 days.

(21) Appl. No.: 15/632,812

(22) Filed: Jun. 26, 2017

(65) Prior Publication Data

US 2018/0372370 A1 Dec. 27, 2018

(51) Int. Cl.
*F24F 13/00* (2006.01)
*F24F 13/22* (2006.01)
(Continued)

(52) U.S. Cl.
CPC ..... *F24F 13/222* (2013.01); *F24F 3/1405* (2013.01); *F24F 13/06* (2013.01);
(Continued)

(58) Field of Classification Search
CPC ..... F24F 13/222; F24F 3/14; F24F 2003/144; F24F 2003/1446; F24F 2013/202; F24F 2013/227; F24F 13/22; F24F 2013/225
See application file for complete search history.

(56) References Cited

U.S. PATENT DOCUMENTS 4,924,939 A * 5/1990 Kim ..... F24F 3/153 165/171
5,212,958 A * 5/1993 Anderson ..... B01D 5/009 417/36

(Continued)

FOREIGN PATENT DOCUMENTS

JP 10274426 A * 10/1998 ..... F24F 3/153

OTHER PUBLICATIONS

Canadian Intellectual Property Office, Canadian Office Action, Application No. 3,007,611, dated Aug. 23, 2018, 4 pages.

*Primary Examiner* — Frantz F Jules
*Assistant Examiner* — Lionel Nouketcha
(74) *Attorney, Agent, or Firm* — Baker Botts L.L.P.

(57) ABSTRACT

A portable dehumidifier includes multiple microchannel condenser coils, a fan, a water reservoir, and a bracket. The fan is located adjacent to an airflow outlet and is configured to generate an airflow that flows into the portable dehumidifier through an airflow inlet and out of the portable dehumidifier through the airflow outlet. The airflow flows through an evaporator and the plurality of microchannel condenser coils in order to provide dehumidification to the airflow. The water reservoir is located at least partially below the evaporator and is configured to store water removed from the airflow. The water reservoir includes a top that is at least partially open to capture water falling from the evaporator. The bracket is coupled to a compressor and covers a portion of the open top of the water reservoir in order to prevent the water from spilling when the portable dehumidifier is tilted at an angle.

14 Claims, 18 Drawing Sheets

(51) Int. Cl.

| | |
|---|---|
| ***F24F 3/14*** | (2006.01) |
| ***F24F 13/20*** | (2006.01) |
| ***F24F 13/06*** | (2006.01) |

(52) U.S. Cl.

CPC ..... *F24F 13/20* (2013.01); *F24F 3/14* (2013.01); *F24F 2003/144* (2013.01); *F24F 2003/1446* (2013.01); *F24F 2013/202* (2013.01); *F24F 2013/205* (2013.01); *F24F 2013/227* (2013.01); *F24F 2221/125* (2013.01)

(56) References Cited

U.S. PATENT DOCUMENTS

| | | | | |
|---|---|---|---|---|
| 8,640,472 | B2 * | 2/2014 | Dieckmann | F24F 3/153 62/93 |
| 9,057,557 | B2 * | 6/2015 | Tudor | F24F 3/1405 |
| 9,920,976 | B2 * | 3/2018 | Lee | F25D 21/14 |
| 2002/0069653 | A1 * | 6/2002 | Goodchild | B01D 5/0039 62/188 |
| 2007/0101738 | A1 * | 5/2007 | Akei | F25B 1/00 62/238.6 |
| 2008/0104974 | A1 * | 5/2008 | Dieckmann | F24F 3/153 62/93 |
| 2009/0165487 | A1 * | 7/2009 | Stubler | F04B 39/121 62/291 |
| 2015/0308732 | A1 | 10/2015 | Lee et al. | |
| 2016/0334118 | A1 * | 11/2016 | Ahn | F24F 3/1405 |
| 2017/0115015 | A1 * | 4/2017 | Beilfuss | F24F 3/1405 |
| 2018/0266709 | A1 * | 9/2018 | Tucker | F24F 3/1405 |

* cited by examiner

WATER RESERVOIR FOR A PORTABLE DEHUMIDIFIER

TECHNICAL FIELD

This invention relates generally to dehumidification and more particularly to water reservoir for a portable dehumidifier.

BACKGROUND OF THE INVENTION

In certain situations, it is desirable to reduce the humidity of air within a structure. For example, in fire and flood restoration applications, it may be desirable to quickly remove water from areas of a damaged structure. To accomplish this, one or more portable dehumidifiers may be placed within the structure to dehumidify the air and direct dry air toward water-damaged areas. Current dehumidifiers, however, have proven inefficient in various respects.

SUMMARY OF THE INVENTION

According to embodiments of the present disclosure, disadvantages and problems associated with previous dehumidification systems may be reduced or eliminated.

In some embodiments, a portable dehumidifier includes two wheels, a cabinet, an evaporator, a plurality of microchannel condenser coils, a fan, a compressor, a water reservoir, and a bracket. The cabinet includes an airflow inlet located on a front side of the cabinet and an airflow outlet located on a back side of the cabinet that is opposite the front side. The evaporator is located adjacent to the airflow inlet. The fan is located adjacent to the airflow outlet and is configured to generate an airflow that flows into the cabinet through the airflow inlet and out of the cabinet through the airflow outlet. The airflow flows through the evaporator and the plurality of microchannel condenser coils in order to provide dehumidification to the airflow. The compressor is located within the airflow between the evaporator and the plurality of microchannel condenser coils. The water reservoir is located at least partially below the evaporator and is configured to store water removed from the airflow. The water reservoir includes a top that is at least partially open to capture water falling from the evaporator. The bracket is coupled to the compressor and covers a portion of the at least partially open top of the water reservoir in order to prevent the water from spilling out of the water reservoir when the portable dehumidifier is tilted at an angle.

In some embodiments, a portable dehumidifier includes a cabinet, a plurality of microchannel condenser coils, a fan, a water reservoir, and a bracket. The cabinet includes an airflow inlet and an airflow outlet. The fan is located adjacent to the airflow outlet and is configured to generate an airflow that flows into the cabinet through the airflow inlet and out of the cabinet through the airflow outlet. The airflow flows through an evaporator and the plurality of microchannel condenser coils in order to provide dehumidification to the airflow. The water reservoir is located at least partially below the evaporator and is configured to store water removed from the airflow. The water reservoir includes a top that is at least partially open to capture water falling from the evaporator. The bracket is coupled to a compressor and covers a portion of the at least partially open top of the water reservoir in order to prevent the water from spilling out of the water reservoir when the portable dehumidifier is tilted at an angle.

In certain embodiments, a portable dehumidifier includes multiple microchannel condenser coils, a fan, a water reservoir, and a bracket. The fan is located adjacent to an airflow outlet and is configured to generate an airflow that flows into the portable dehumidifier through an airflow inlet and out of the portable dehumidifier through the airflow outlet. The airflow flows through an evaporator and the plurality of microchannel condenser coils in order to provide dehumidification to the airflow. The water reservoir is located at least partially below the evaporator and is configured to store water removed from the airflow. The water reservoir includes a top that is at least partially open to capture water falling from the evaporator. The bracket is coupled to a compressor and covers a portion of the open top of the water reservoir in order to prevent the water from spilling when the portable dehumidifier is tilted at an angle.

Certain embodiments of the present disclosure may provide one or more technical advantages. For example, certain embodiments provide a portable dehumidifier that is more compact and rugged than existing systems. Certain embodiments include a retractable handle that pivots to an angle when the portable dehumidifier is being transported but retracts into the portable dehumidifier for storage. In some embodiments, the portable dehumidifier includes various stacking features that allow two or more portable dehumidifiers to be securely stacked on top of each other. In some embodiments, the portable dehumidifier utilizes two microchannel condensers in series in order to more efficiently provide dehumidification. In some embodiments, the portable dehumidifier includes a control panel that provides an LED status window that may provide a status of the portable dehumidifier that is easily discernable from a distance.

Certain embodiments of the present disclosure may include some, all, or none of the above advantages. One or more other technical advantages may be readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description taken in conjunction with the accompanying drawings, in which.

DETAILED DESCRIPTION OF THE DRAWINGS

In certain situations, it is desirable to reduce the humidity of air within a structure. For example, in fire and flood restoration applications, it may be desirable to remove water from a damaged structure by placing one or more portable dehumidifiers within the structure. Current dehumidifiers, however, have proven inadequate or inefficient in various respects.

The disclosed embodiments provide a portable dehumidifier that includes various features to address the inefficiencies and other issues with current portable dehumidification systems. In some embodiments, a portable dehumidifier includes a retractable handle that pivots to an angle when the portable dehumidifier is being transported but retracts into the portable dehumidifier for storage. In some embodiments, the portable dehumidifier includes various stacking features that allow two or more portable dehumidifiers to be securely stacked on top of each other. In some embodiments, the portable dehumidifier utilizes two microchannel condensers in series in order to more efficiently provide dehumidification. In some embodiments, the portable dehumidifier includes a control panel that provides an LED status bar that may provide a status of the portable dehumidifier that is easily discernable from a distance.

Figure 1:
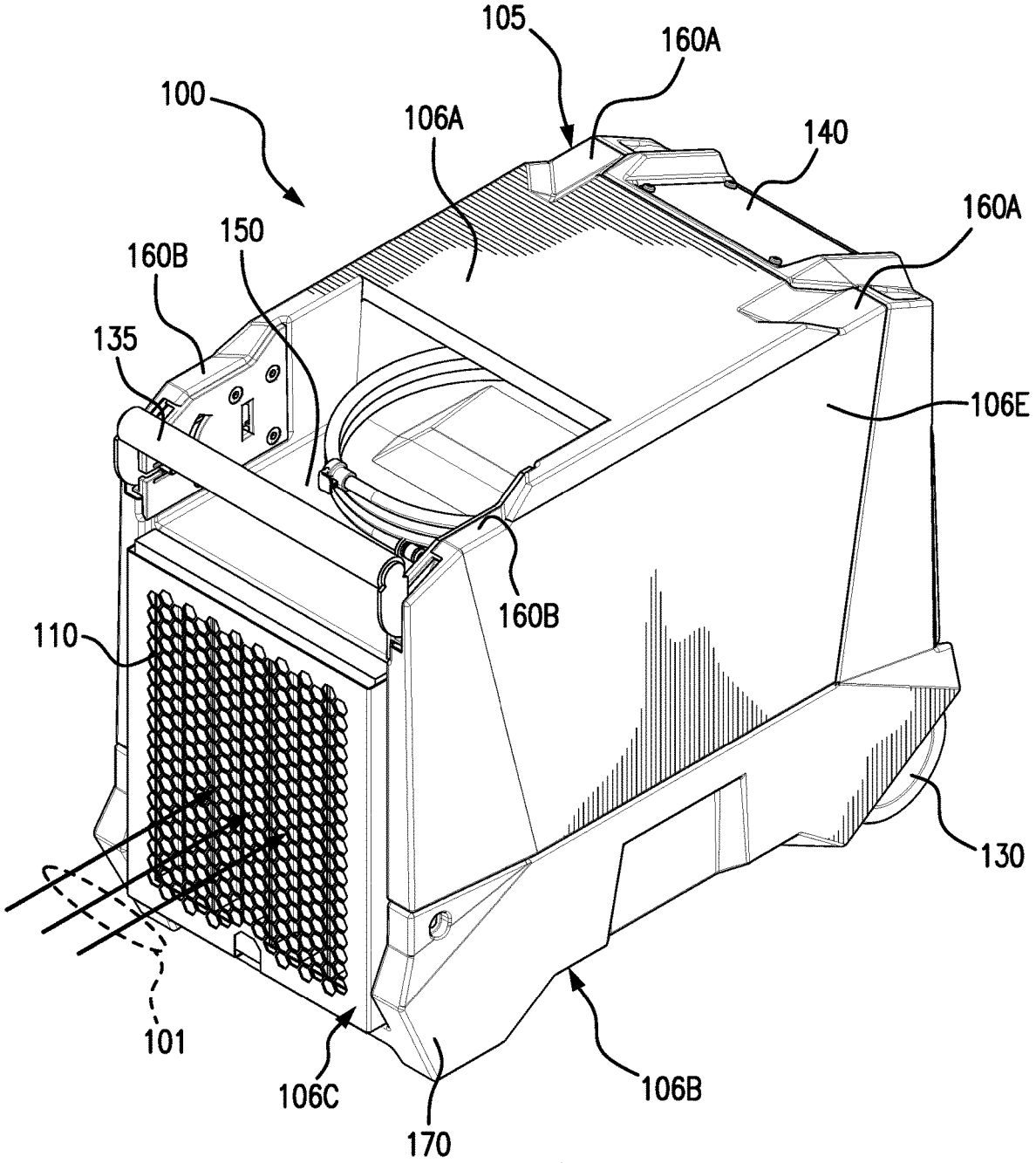
FIGS. 1-2 illustrate perspective views of a portable dehumidifier, according to certain embodiments.
Figure 2:
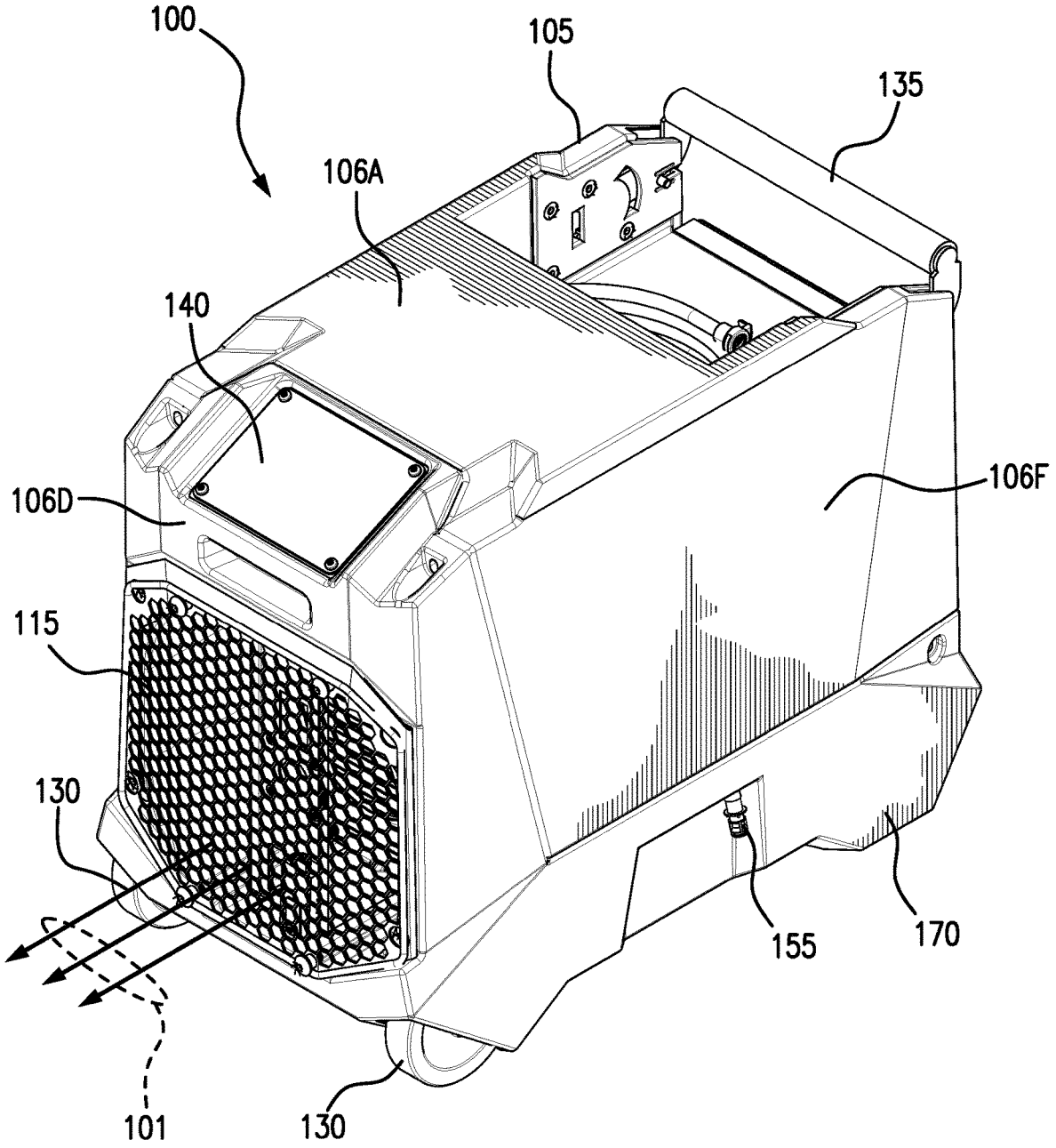
Figure 3:
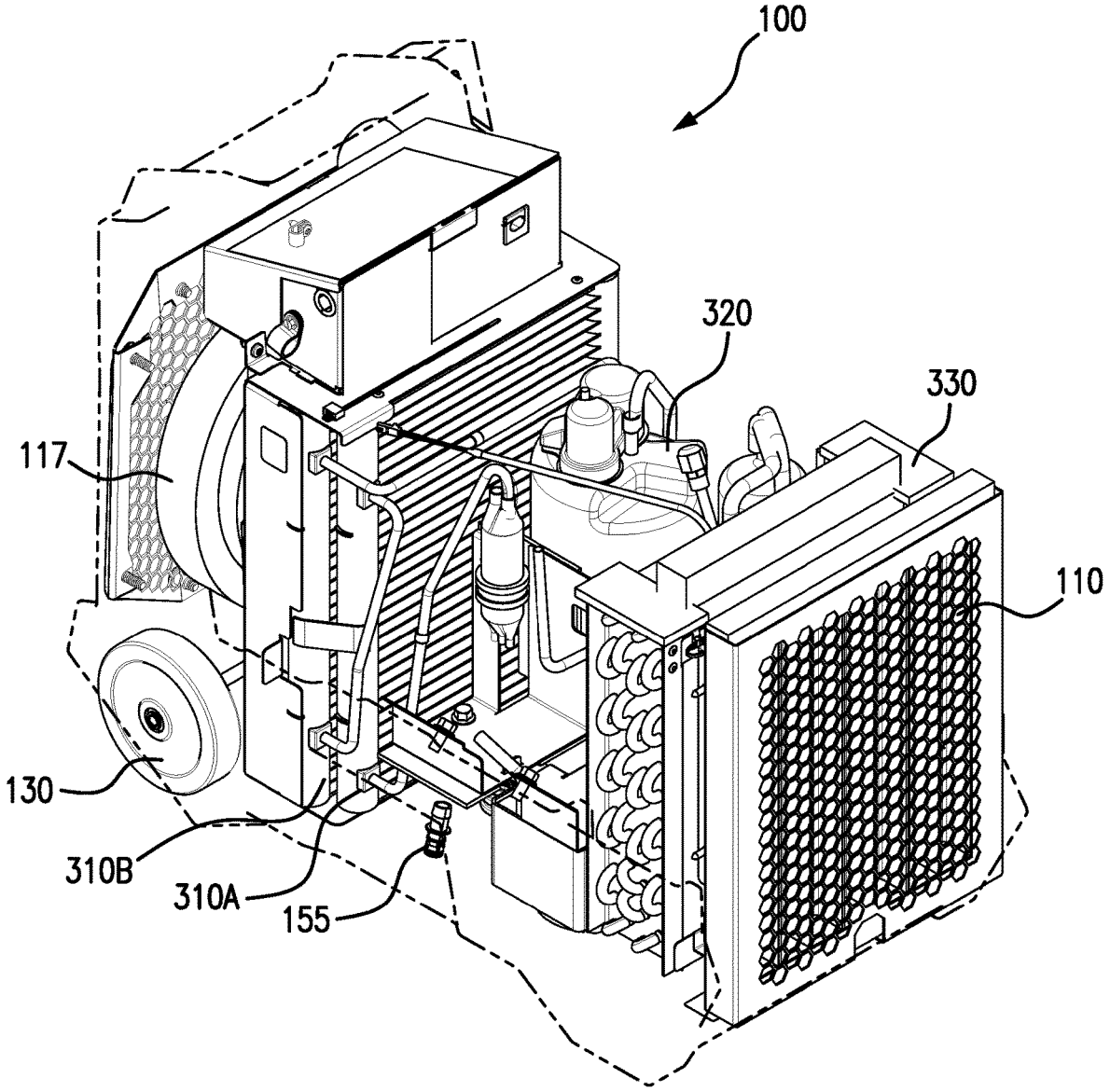
FIGS. 3-4 illustrate cut-away side views of the portable dehumidifier of FIGS. 1-2, according to certain embodiments.
Figure 4:
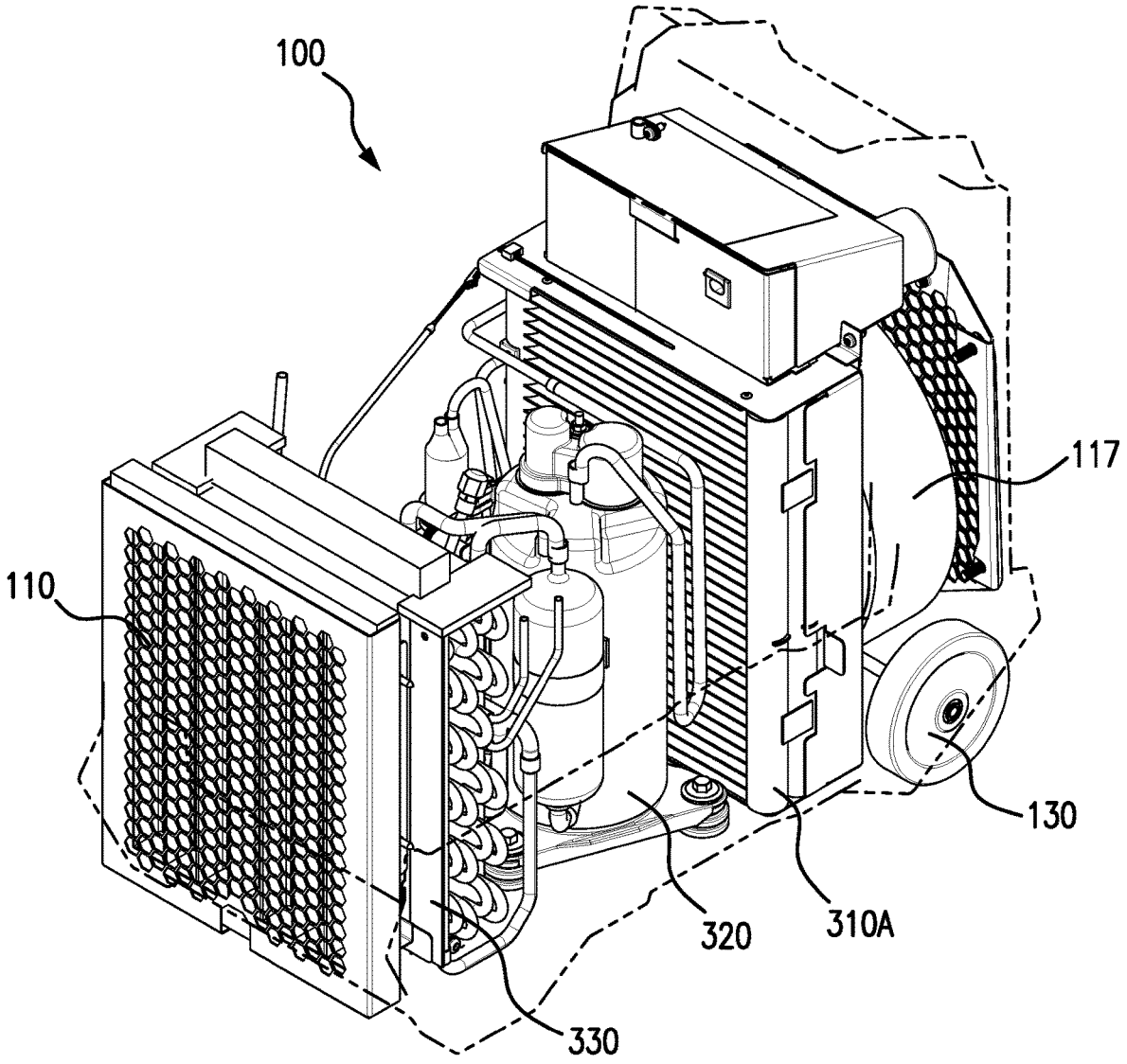
Figure 5:
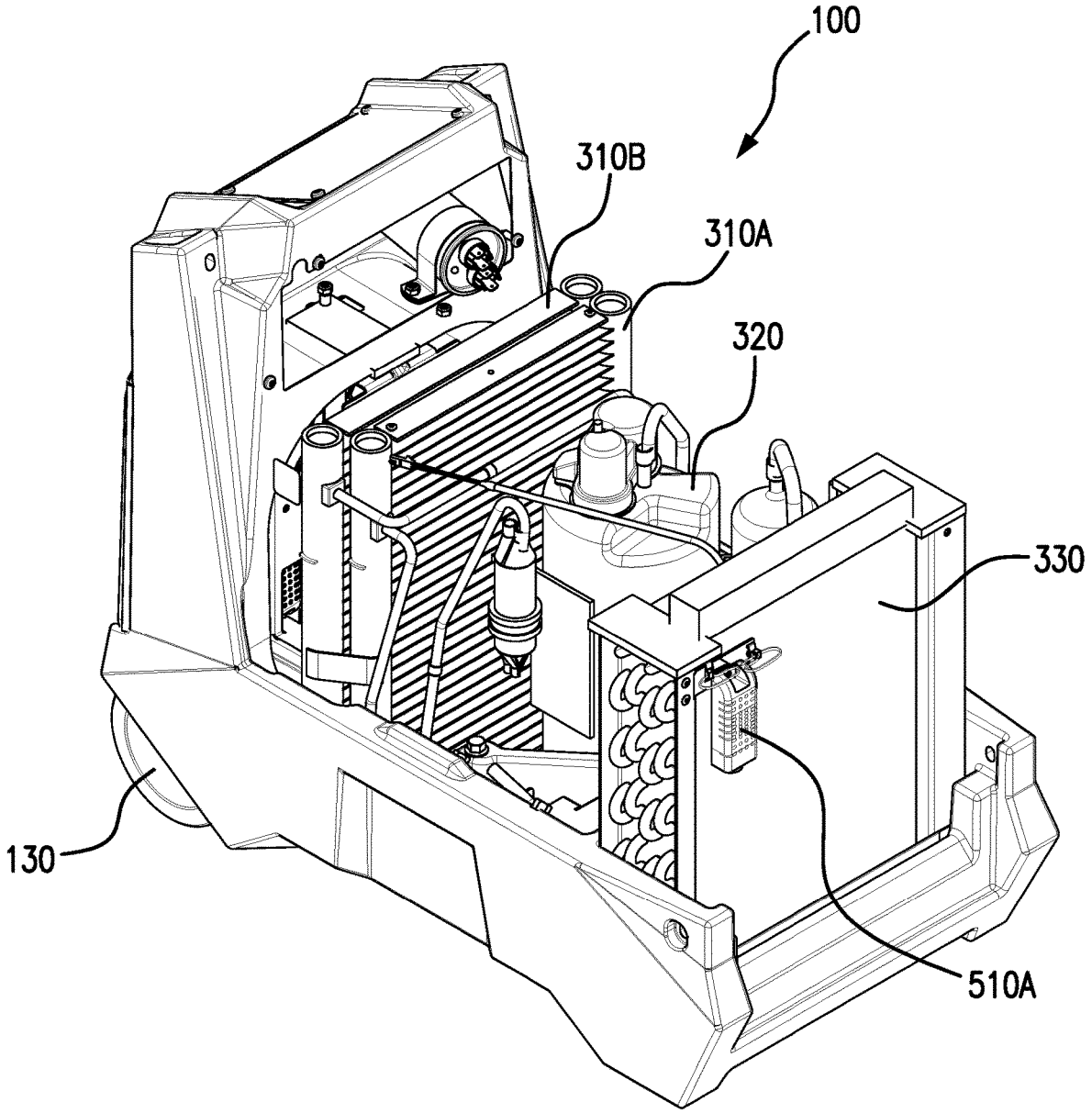
FIGS. 5-6 illustrate sensor locations of the portable dehumidifier of FIGS. 1-2, according to certain embodiments.
Figure 6:
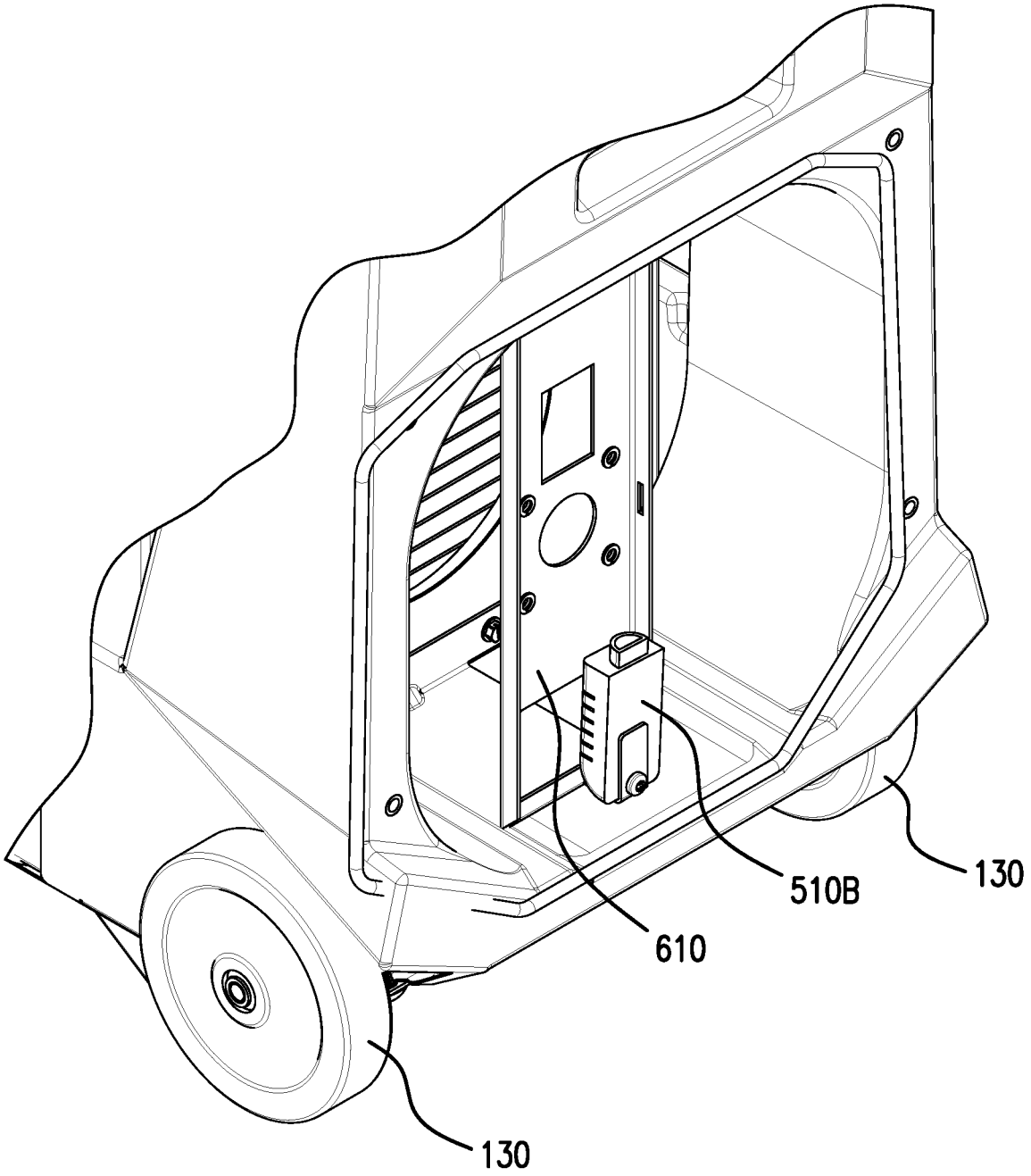
Figure 7:
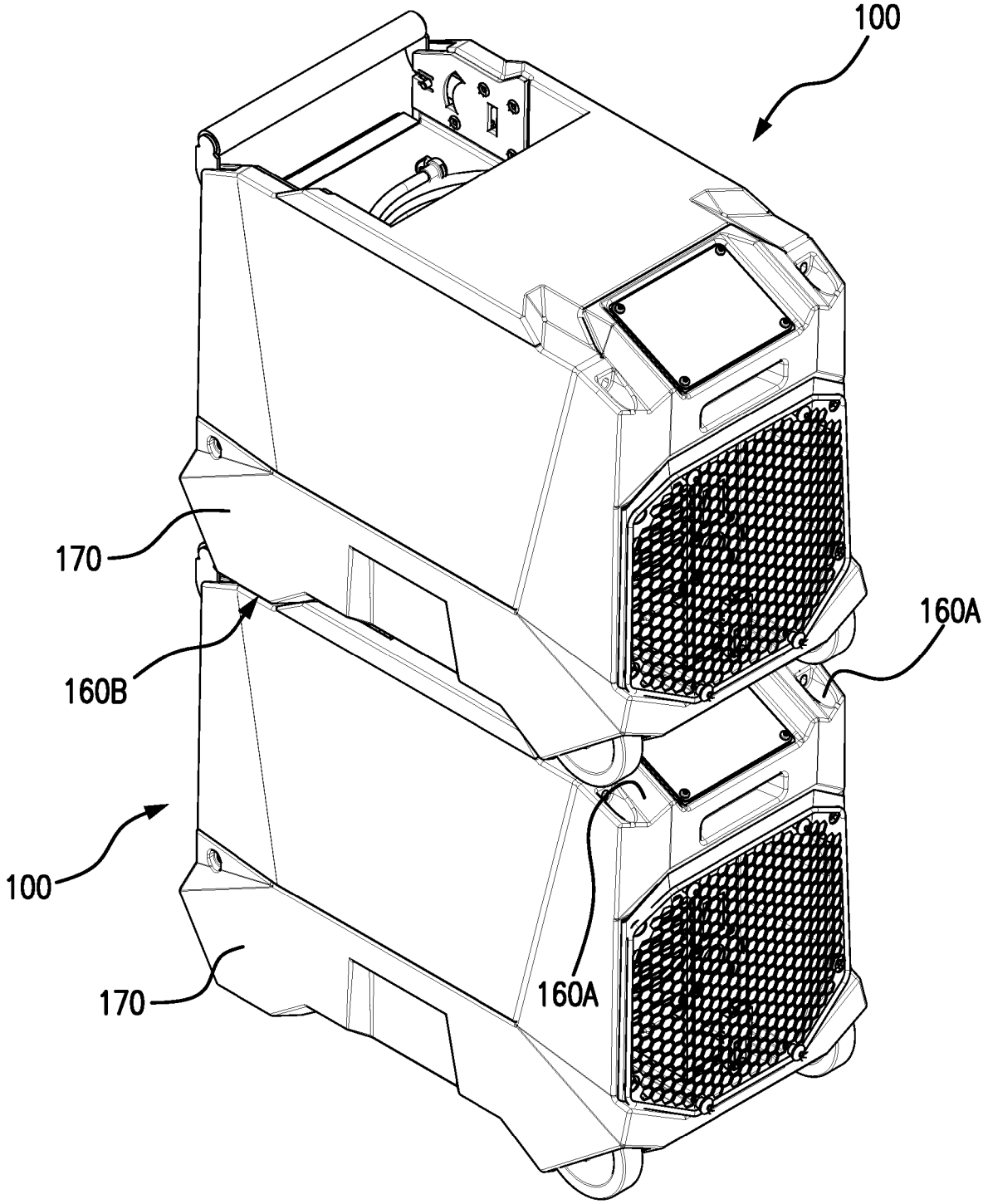
FIG. 7 illustrates a stacking feature of the portable dehumidifier of FIGS. 1-2, according to certain embodiments.
Figure 8:
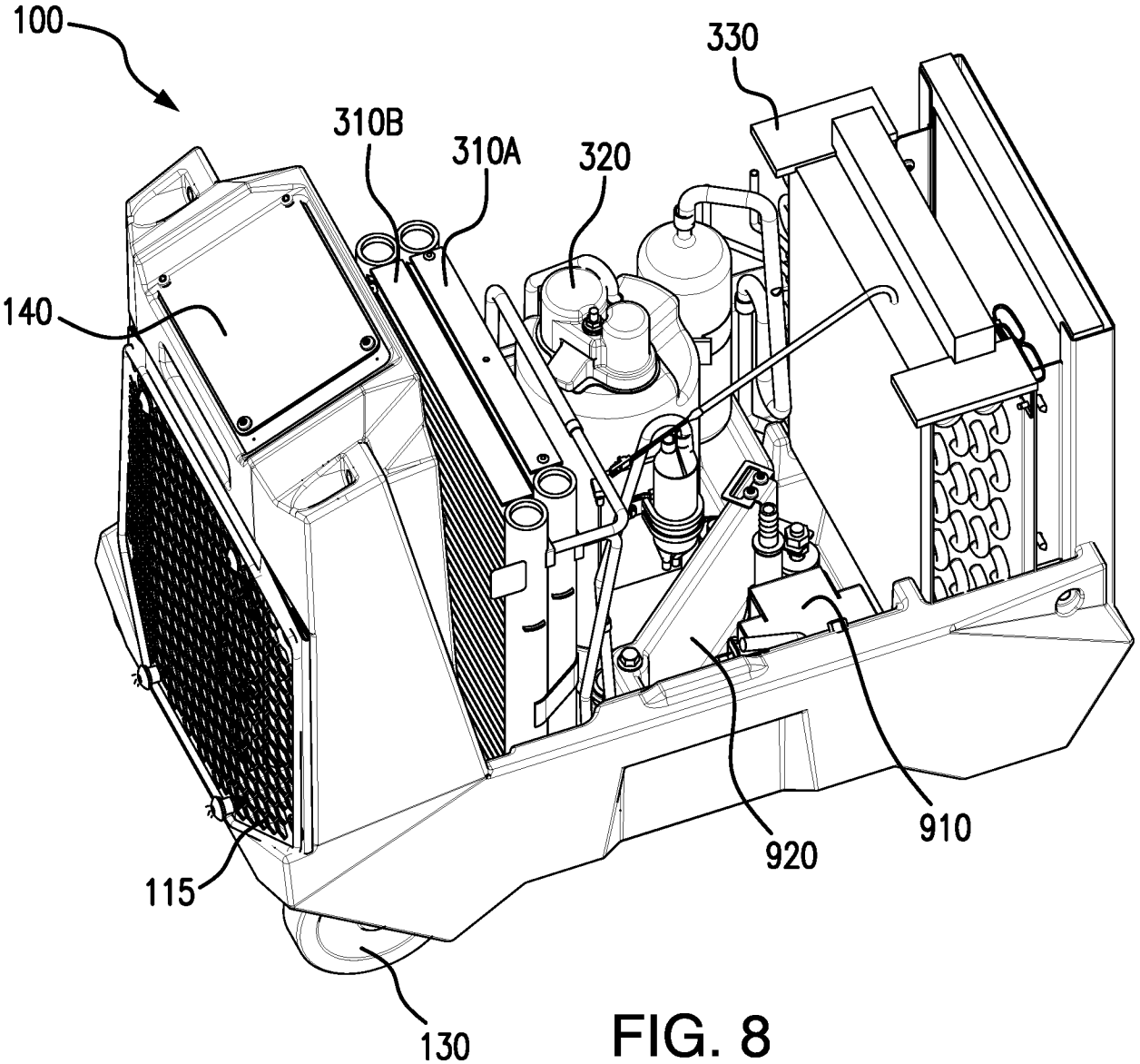
FIGS. 8-9 illustrate a water reservoir of the portable dehumidifier of FIGS. 1-2, according to certain embodiments.
Figure 9:
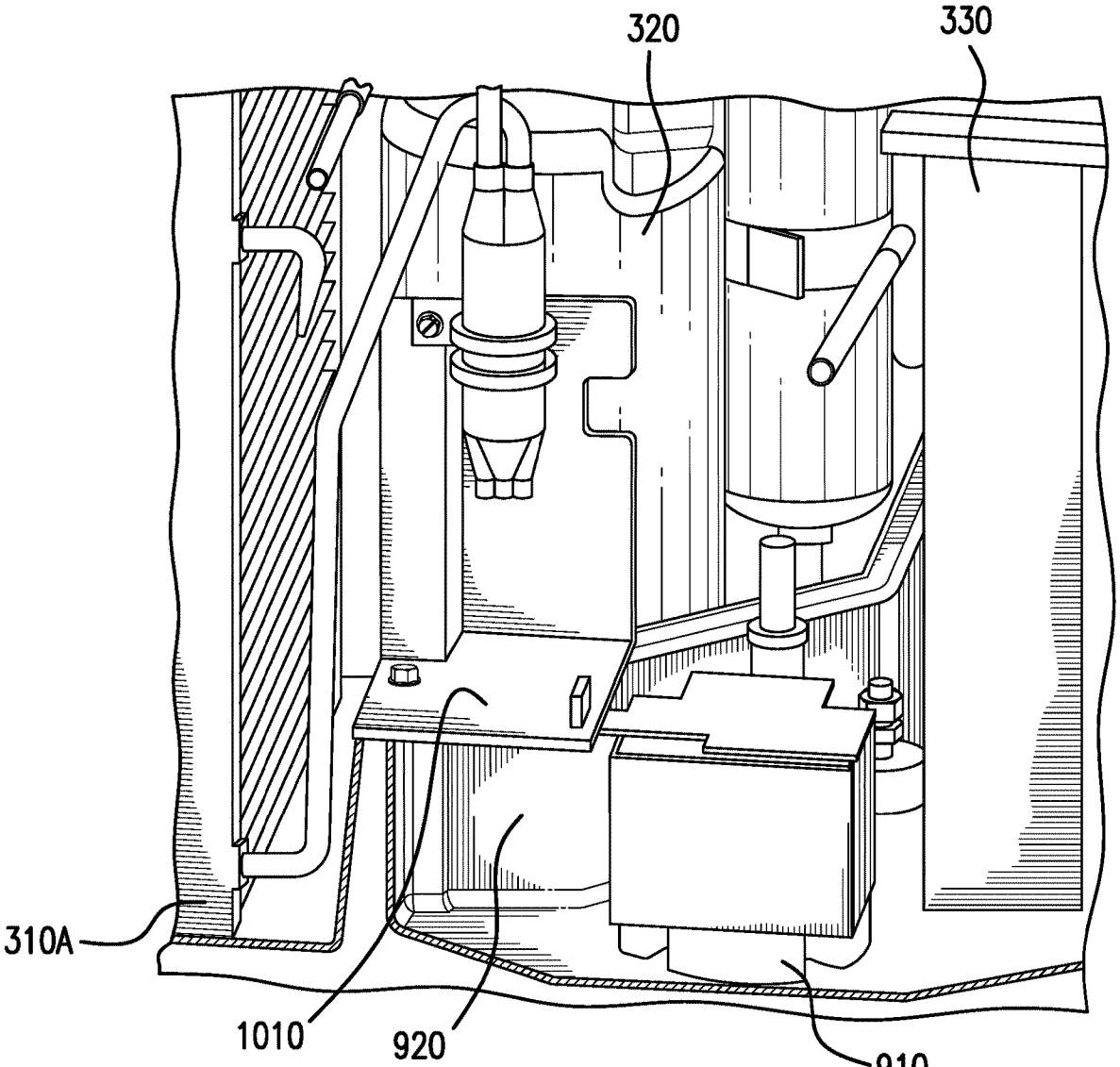
Figure 14:
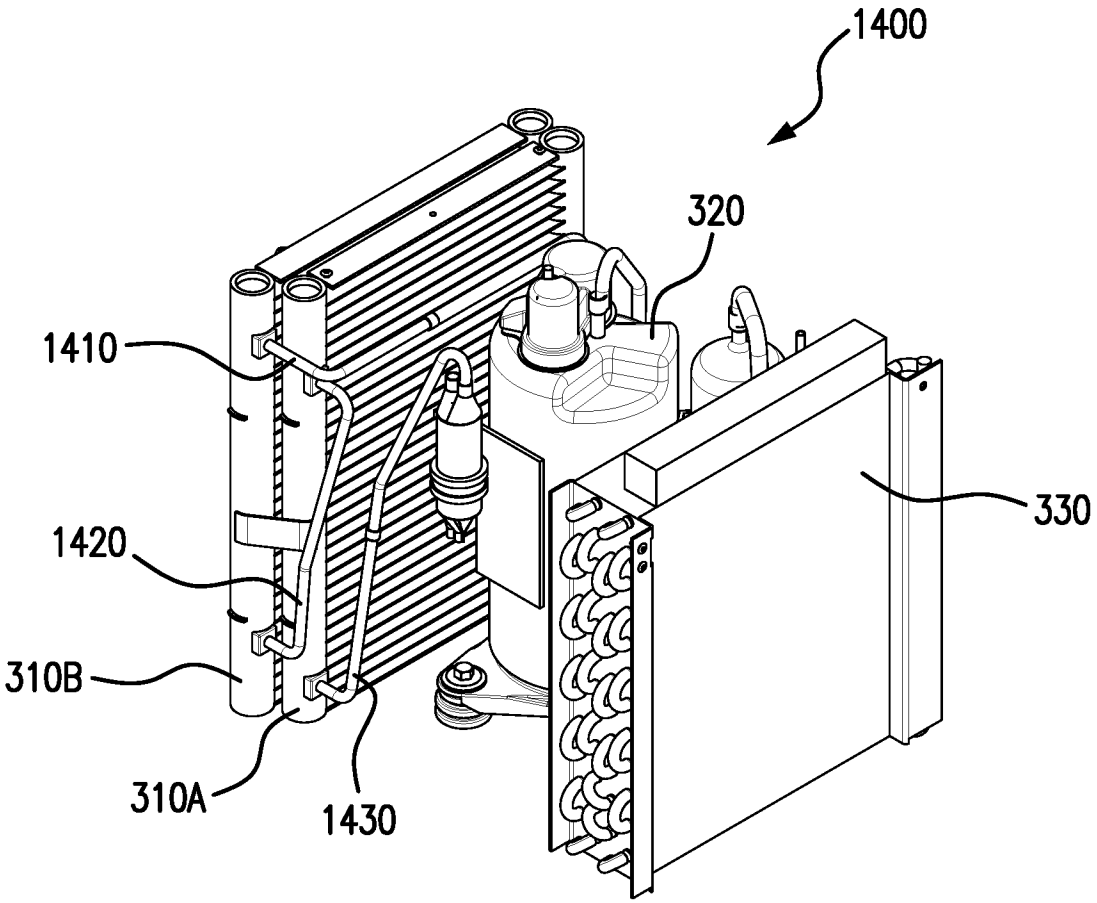
FIG. 14 illustrates a dehumidification system with dual condenser coils that may be used by the portable dehumidifier of FIGS. 1-2, according to certain embodiments.
Figure 15:
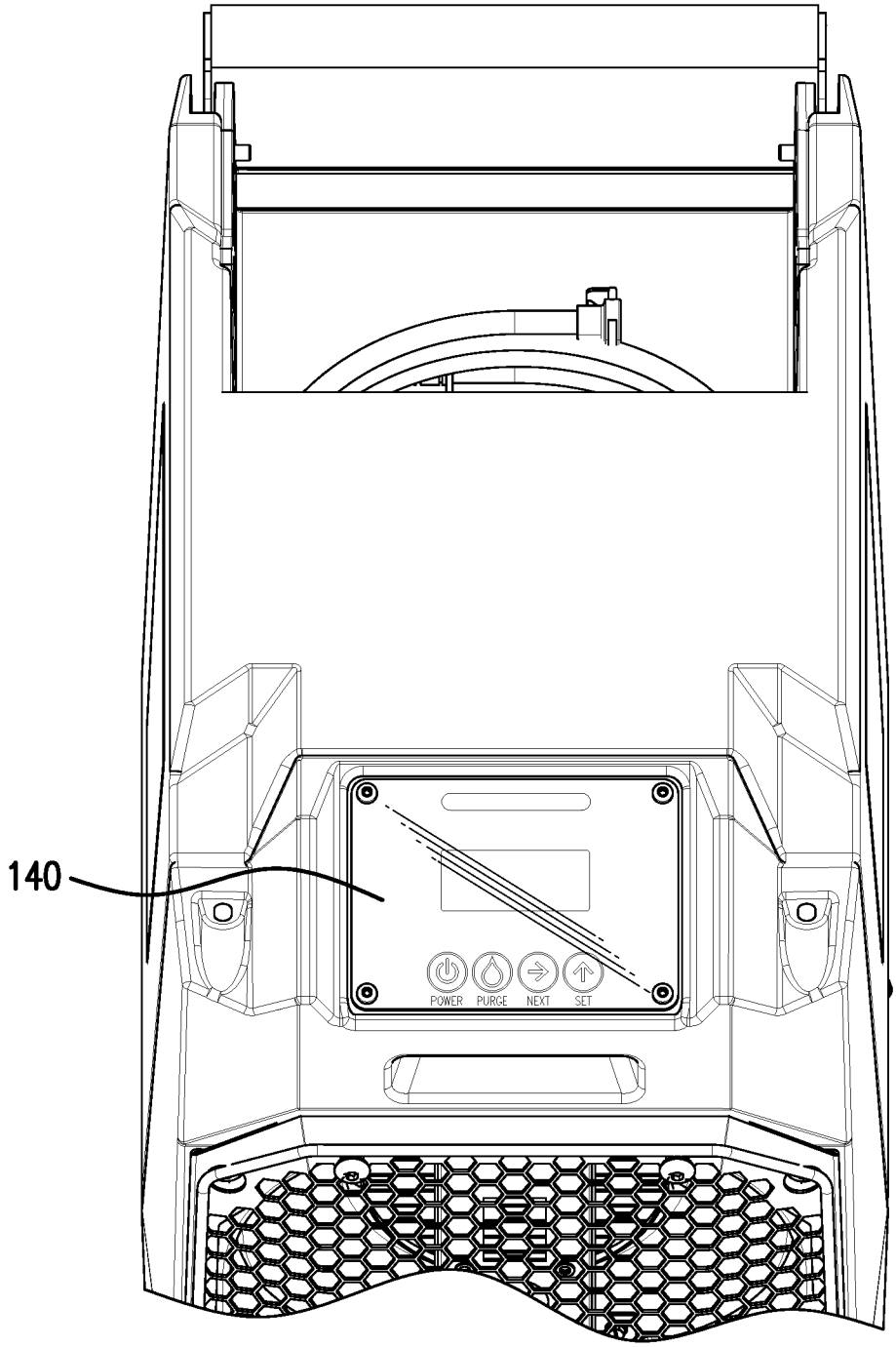
FIGS. 15-16 illustrate a control panel of the portable dehumidifier of FIGS. 1-2, according to certain embodiments.
Figure 16:
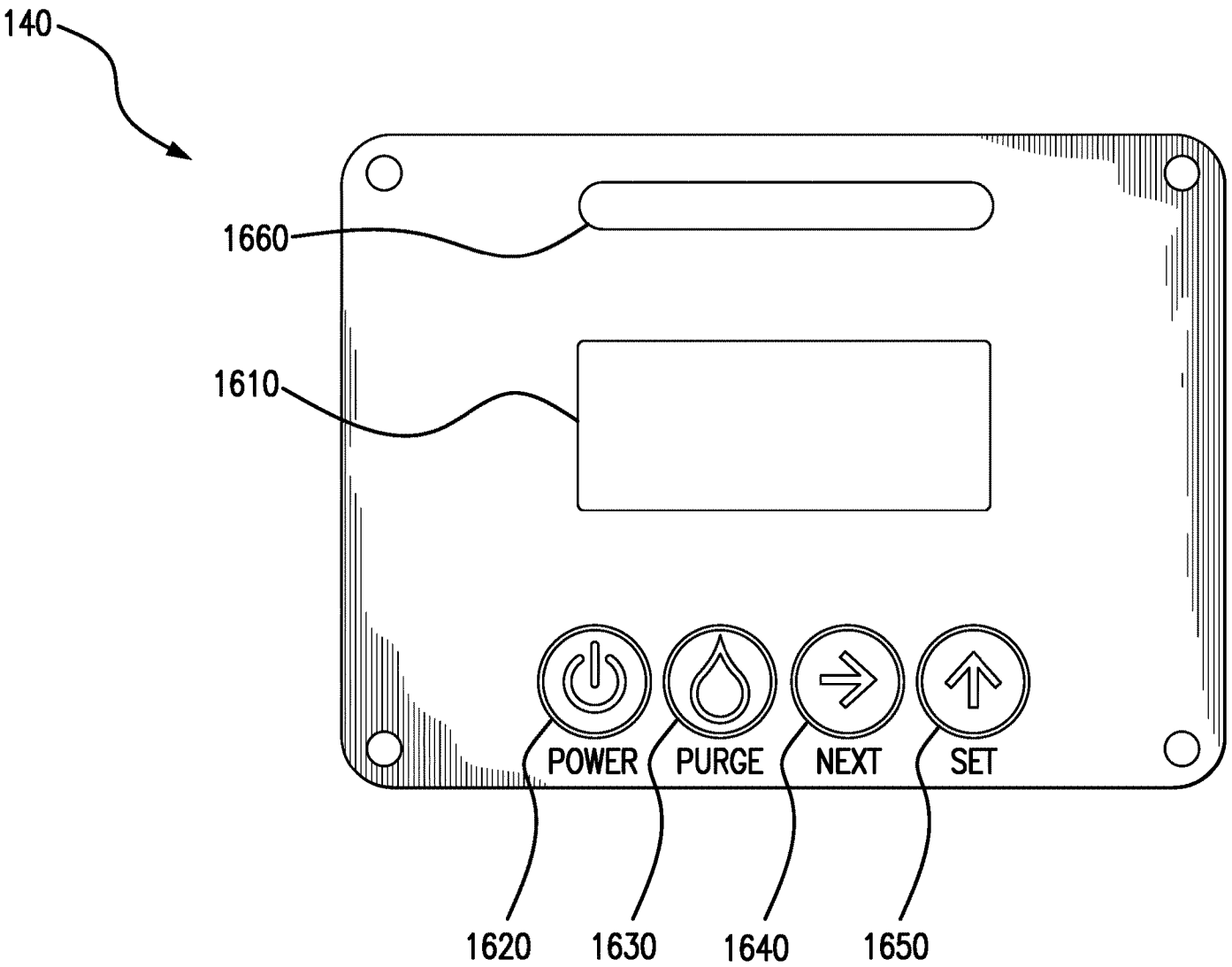
Figure 17:
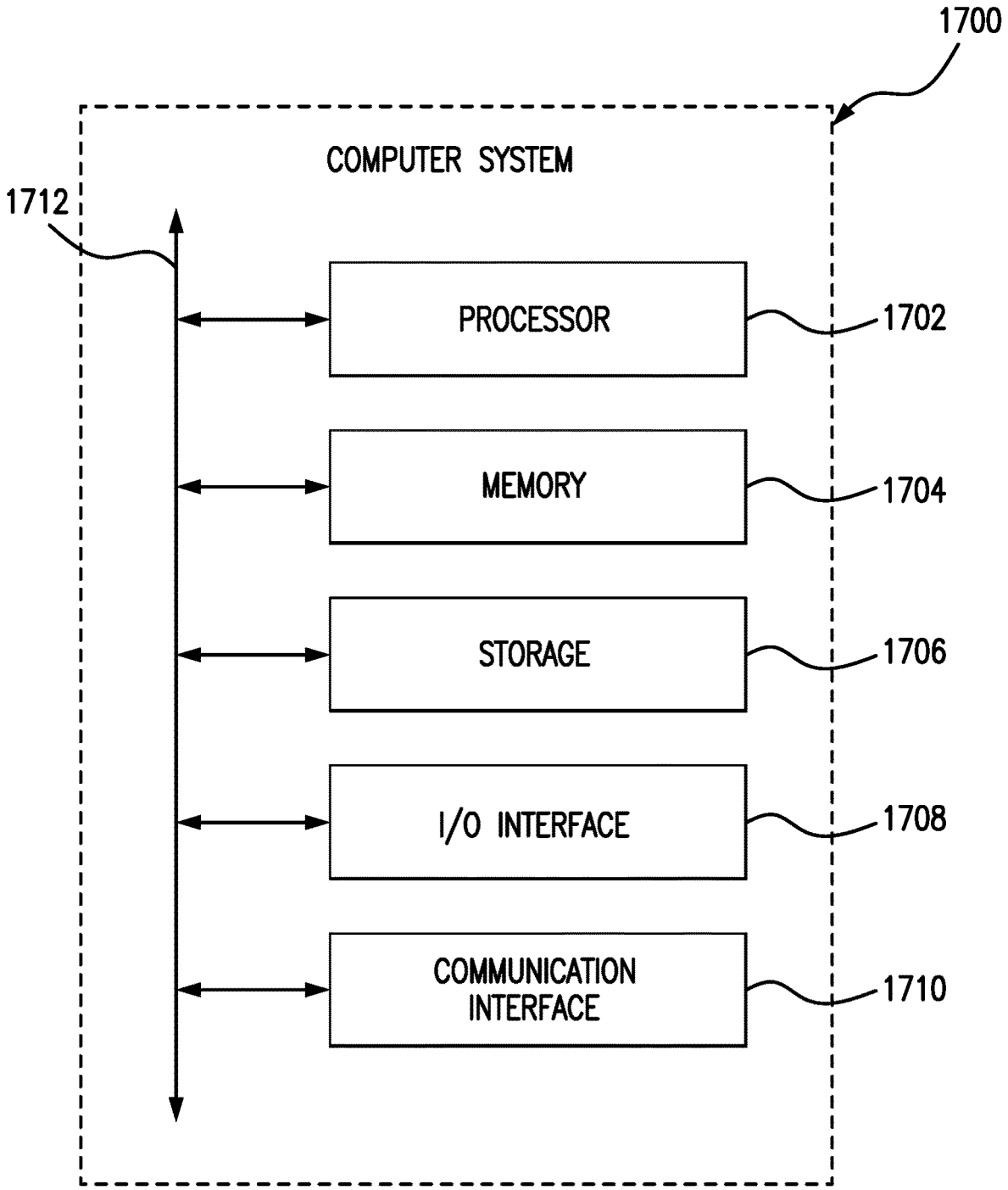
FIG. 17 illustrates a computer system that may be used by the portable dehumidifier of FIGS. 1-2, according to certain embodiments.

These and other advantages and features of certain embodiments are discussed in more detail below in reference to FIGS. 1-17. FIGS. 1-2 illustrate perspective views of certain embodiments of a portable dehumidifier; FIGS. 3-4 illustrate cut-away side views of certain embodiments of a portable dehumidifier; FIGS. 5-6 illustrate sensor locations of certain embodiments of a portable dehumidifier; FIG. 7 illustrates a stacking feature of certain embodiments of a portable dehumidifier; FIGS. 8-9 illustrate a water reservoir of certain embodiments of a portable dehumidifier; FIGS. 10-13 illustrate a handle mechanism of certain embodiments of a portable dehumidifier; FIG. 14 illustrates a dehumidification system with dual condenser coils that may be used by certain embodiments of a portable dehumidifier; FIGS. 15-16 illustrate a control panel of certain embodiments of a portable dehumidifier; and FIG. 17 illustrates a computer system of certain embodiments of a portable dehumidifier.

FIGS. 1-4 illustrate perspective and cut-away views of a portable dehumidifier 100, according to certain embodiments. In some embodiments, portable dehumidifier 100 includes a cabinet 105, an airflow inlet 110, an airflow outlet 115, two or more wheels 130, and a handle 135. While a specific arrangement of these and other components of portable dehumidifier 100 are illustrated in these figures, other embodiments may have other arrangements and may have more or fewer components than those illustrated.

In general, portable dehumidifier 100 provides dehumidification to an area (e.g., a room, a floor, etc.) by moving air through portable dehumidifier 100. To dehumidify air, portable dehumidifier 100 generates an airflow 101 that enters cabinet 105 via airflow inlet 110, travels through a dehumidification system (e.g., dehumidification system 1400 described below) where it is dried, and then exits cabinet 105 via airflow outlet 115. Water removed from airflow 101 via the dehumidification system may be captured within a water reservoir of portable dehumidifier 100 where it may be later removed via, for example, a drain 155. A particular embodiment of a water reservoir is described in more detail below in reference to FIGS. 8-9.

Cabinet 105 may be any appropriate shape and size. In some embodiments, cabinet 105 includes multiple sides 106. For example, some embodiments of cabinet 105 include a top side 106A, a bottom side 106B, a front side 106C, a back side 106D, a right side 106E, and a left side 106F as illustrated in the figures. In some embodiments, airflow inlet 110 is on front side 106C and airflow outlet 115 is on back side 106D.

In some embodiments, all or a portion of cabinet 105 is removable for maintenance and service to portable dehumidifier 100. For example, cabinet 105 may include separate top and lower portions that are coupled to each other using any appropriate fasteners (e.g., screws, bolts, etc.). As illustrated in FIG. 5, the top portion of cabinet 105 may be easily removed by removing a certain number of fasteners that are accessible from the outside of cabinet 105. In some embodiments, the fasteners used to attach the top portion of cabinet 105 to its lower portion may be captive in the lower portion so that the fasteners may not be lost when the upper portion is removed for maintenance or service.

Airflow inlet 110 is generally any opening in which airflow 101 enters portable dehumidifier 100. In some embodiments, airflow inlet 110 is square or rectangular in shape as illustrated. In other embodiments, airflow inlet 110 may have any other appropriate shape or dimensions. In some embodiments, airflow inlet 110 includes a grate or grill that is formed out of geometric shapes. For example, some embodiments of airflow inlet 110 include a grill formed from hexagons, octagons, and the like. In some embodiments, a removable air filter may be installed proximate to airflow inlet 110 to filter airflow 101 as it enters portable dehumidifier 100. In some embodiments, airflow inlet 110 is located on front side 106C as illustrated in the figures, but may be in any other appropriate location on other embodiments of portable dehumidifier 100.

Airflow outlet 115 is generally any opening in which airflow 101 exits portable dehumidifier 100 after it has passed through a dehumidification system of portable dehumidifier 100 such as dehumidification system 1400 for dehumidification. Similar to airflow inlet 110, airflow outlet 115 includes a grate or grill that is formed out of geometric shapes such as hexagons, octagons, and the like. Airflow outlet 115 may be square or rectangular in shape, but may have any other appropriate shape or dimensions. In some embodiments, airflow outlet 115 is located on back side 106D as illustrated in the figures, but may be in any other appropriate location on other embodiments of portable dehumidifier 100.

Portable dehumidifier 100 includes a fan 117 that, when activated, draws airflow 101 into portable dehumidifier 100 via airflow inlet 110, causes airflow 101 to flow through a dehumidification system such as dehumidification system 1400, and exhausts airflow 101 out of airflow outlet 115. In some embodiments, fan 117 is located within cabinet 105 proximate to airflow outlet 115 as illustrated in FIGS. 3-4. Fan 117 may be any type of air mover (e.g., axial fan, forward inclined impeller, backward inclined impeller, etc.) that is configured to generate airflow 101 that flows through portable dehumidifier 100 for dehumidification and exits portable dehumidifier 100 through airflow outlet 115.

Embodiments of portable dehumidifier 100 may include two or more wheels 130. In some embodiments, portable dehumidifier 100 includes two wheels 130 as illustrated that permit portable dehumidifier 100 to be tilted towards back side 106D and easily transported to a new location. Wheels 130 may be of any size and be made of any appropriate materials.

Some embodiments of portable dehumidifier 100 may include a handle 135. Handle 135 may be used to tilt portable dehumidifier 100 towards back side 106D and rolled to a new location. Particular embodiments of handle 135 and a handle mechanism 1100 are described below in reference to FIGS. 10-13.

Embodiments of portable dehumidifier 100 also include a control panel 140 located in cabinet 105. In general, control panel 140 provides various controls for an operator to control certain functions of portable dehumidifier 100. Certain embodiments of control panel 140 are discussed in more detail below in reference to FIGS. 15-16. While control panel 140 is located on top side 106A close to back side 106D in some embodiments, control panel 140 may be located in any appropriate location on cabinet 105.

In some embodiments, portable dehumidifier 100 includes a storage compartment 150 within cabinet 105. In general, storage compartment 150 provides a convenient location for operators to store hoses, cords, and other items needed for the operation of portable dehumidifier 100. In some embodiments, storage compartment 150 is an open pocket located on top side 106A of cabinet 105 as illustrated. In other embodiments, storage compartment 150 may be in any other appropriate location on cabinet 105 and may include one or more doors or panels to enclose storage compartment 150. Storage compartment 150 allows the operator to store needed accessories (e.g., cords, hoses, etc.) for each job without limiting the ability to stack and store portable dehumidifier 100 in the smallest possible volume during transport.

Portable dehumidifier 100 includes various components to provide dehumidification to airflow 101. Portable dehumidifier 100 may include multiple condenser coils 310, a compressor 320, and an evaporator 330. Particular embodiments of condenser coils 310 are described in more detail below in reference to FIG. 14. These and other internal components of portable dehumidifier 100 are uniquely arranged so as to minimize the size of portable dehumidifier 100. In some embodiments, evaporator 330 is located proximate to airflow inlet 110 as illustrated. In some embodiments, a removable filter may be provided between evaporator 330 and airflow inlet 110 to filter airflow 101 before it enters evaporator 330. In some embodiments, compressor 320 may be located within airflow 101 between evaporator 330 and condenser coils 310, as illustrated. This may provide cooling for compressor 320 and further improve the efficiency of portable dehumidifier 100. Condenser coils 310 may be located close to wheels 130 and back side 106D of cabinet 105 as illustrated. Fan 117 may be installed behind condenser coils 310 and before airflow outlet 115.

FIGS. 5-6 illustrate locations of sensors 510 of portable dehumidifier 100, according to certain embodiments. Sensors 510 may include a front sensor 510A and a rear sensor 510B. As illustrated in FIG. 5, front sensor 510A may be installed between evaporator 330 and airflow inlet 110 so that it may sense airflow 101 before it enters evaporator 330. In some embodiments, front sensor 510A may be located between evaporator 330 and a removable filter (not illustrated) that is immediately behind airflow inlet 110 within cabinet 105. As illustrated in FIG. 6, rear sensor 510B may be installed in any appropriate location within airflow 101 after fan 117. In some embodiments, rear sensor 510B may be installed on a sensor bracket 610 that is behind fan 117 but before airflow outlet 115 as illustrated. Sensor bracket 610 may be made of any appropriate material such as metal and may have one or more cutouts as shown to allow airflow 101 to pass through sensor bracket 610 and into rear sensor 510B. Sensors 510 may be any appropriate sensors such as thermometers, humidistats, pressure sensors, and the like.

FIG. 7 illustrates a stacking feature of portable dehumidifier 100, according to certain embodiments. In some embodiments, cabinet 105 includes stacking recesses 160 and cabinet protrusions 170 that allow portable dehumidifiers 100 to stack with one another. For example, two or more portable dehumidifiers 100 may be stacked on one another for transport and storage. To accomplish this, certain embodiments of portable dehumidifier 100 include two rear stacking recesses 160A, two front stacking recesses 160B, and two cabinet protrusions 170. In general, rear stacking recesses 160A are located on the top edge of cabinet 105 near back side 106D of cabinet 105 and front stacking recesses 106B are located on the top edge of cabinet 105 near front side 106C of cabinet 105 as illustrated. Stacking recesses 160 include various angled recesses and edges that permit wheels 130 and cabinet protrusions 170 from another portable dehumidifier 100 to nest within them. For example, front stacking recesses 160B permit cabinet protrusions 170 of another portable dehumidifier 100 to nest within them, and rear stacking recesses 160A permit wheels 130 of another portable dehumidifier 100 to nest within them. In some embodiments, the shapes of cabinet protrusions 170 match or are complementary to rear stacking recesses 160B so that when one portable dehumidifier 100 is stacked on top of another portable dehumidifier 100, the portable dehumidifier 100 on top may be locked into place and prevented from shifting forward or backward. As a result, stacked portable dehumidifiers 100 may be stable during transport and storage.

FIGS. 8-9 illustrate a water reservoir 920 of portable dehumidifier 100, according to certain embodiments. In general, water reservoir 920 collects water that is removed from airflow 101 by portable dehumidifier 100. In some embodiments, drain 155 is coupled to water reservoir 920 and permits an operator to manually remove collected water from water reservoir 920. For example, an operator may attach a hose to drain 155 and open a valve on drain 155 in order for collected water to drain from water reservoir 920 through the hose. In some embodiments, a water pump 910 may be included within or proximate to water reservoir 920. Water pump 910 may be any electric pump that pumps collected water out of water reservoir 920 (e.g., through drain 155).

Figure 10:
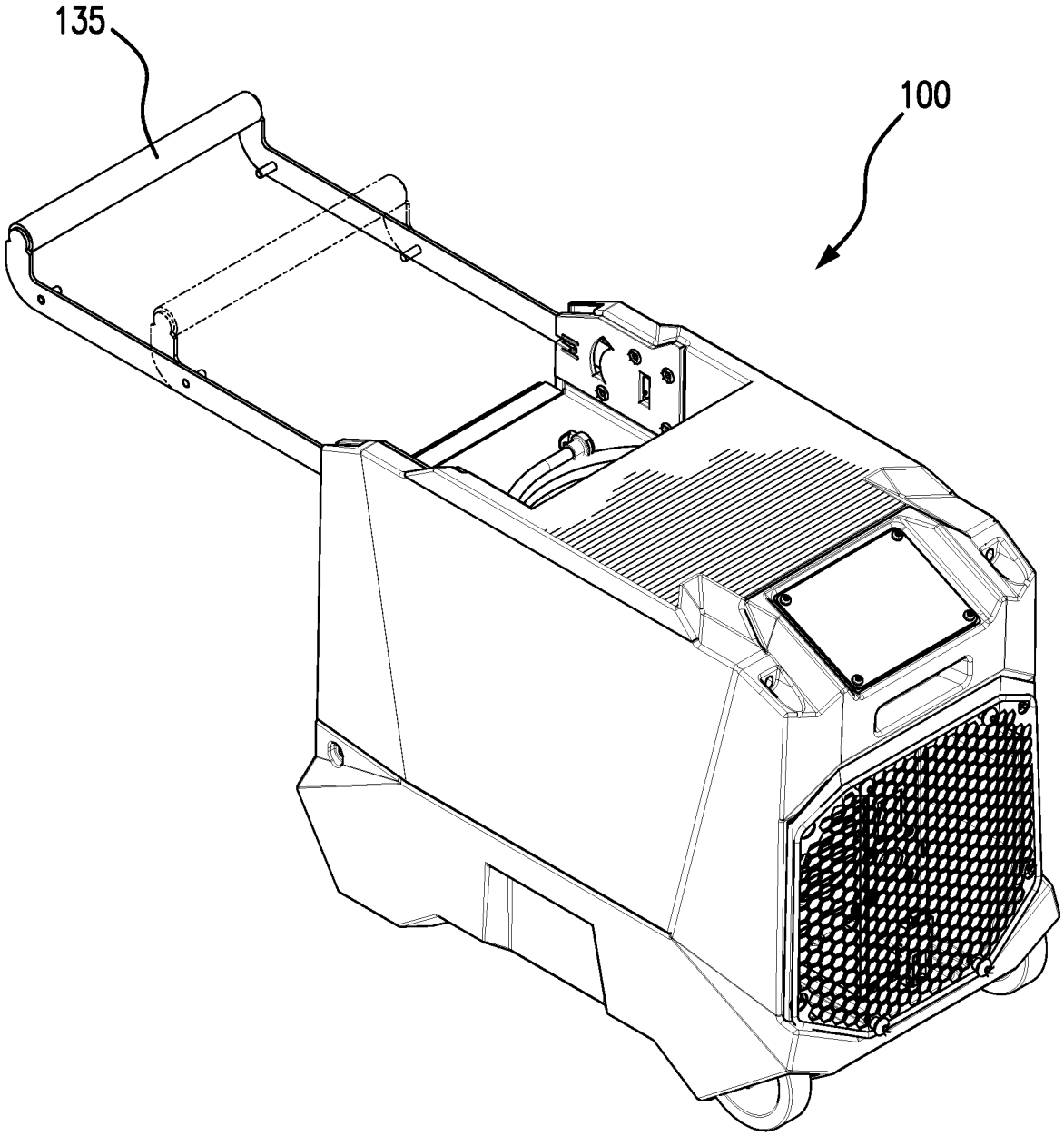
FIGS. 10-13 illustrate a handle mechanism of the portable dehumidifier of FIGS. 1-2, according to certain embodiments.
Figure 11A:
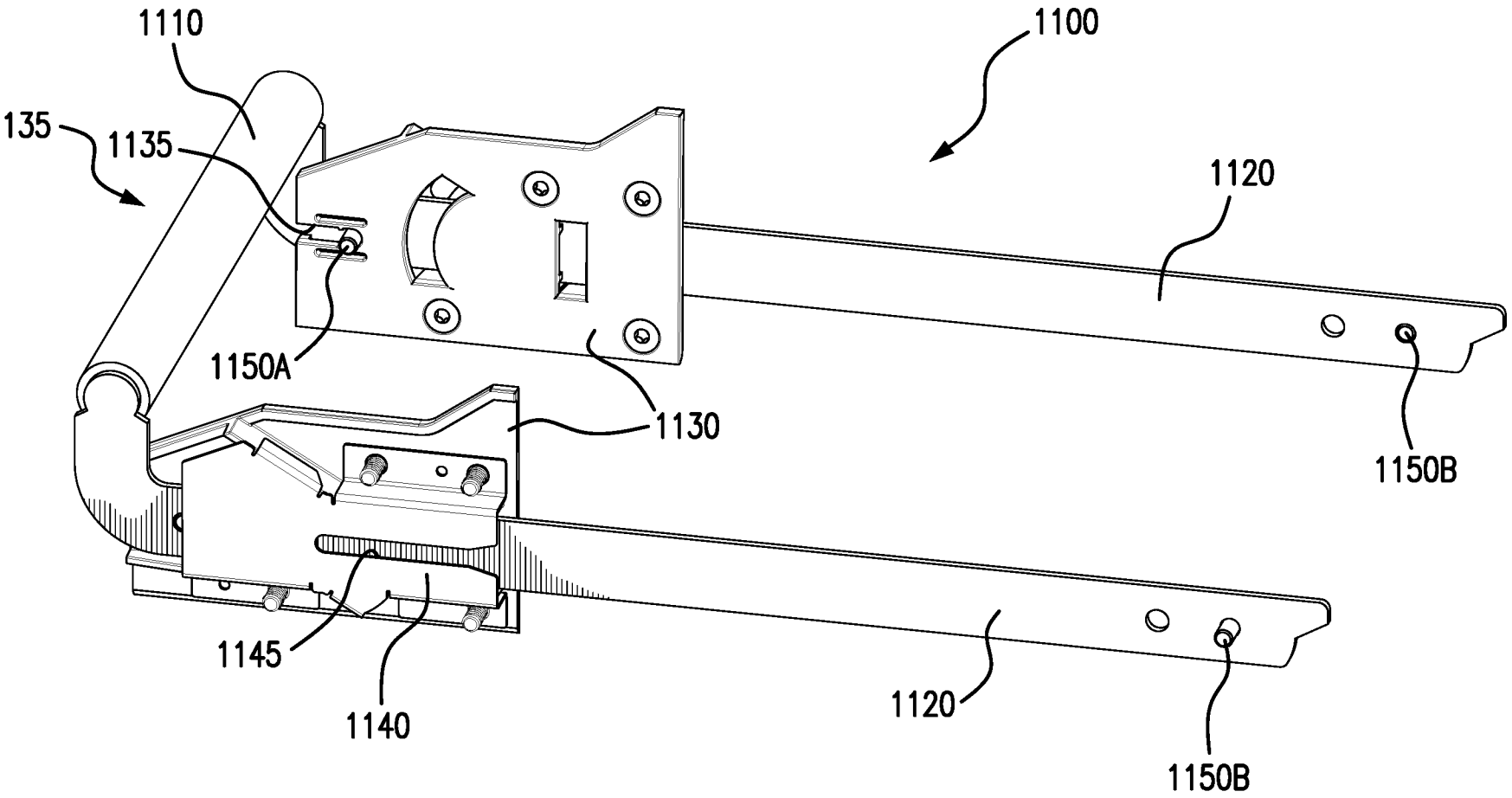
Figure 11B:
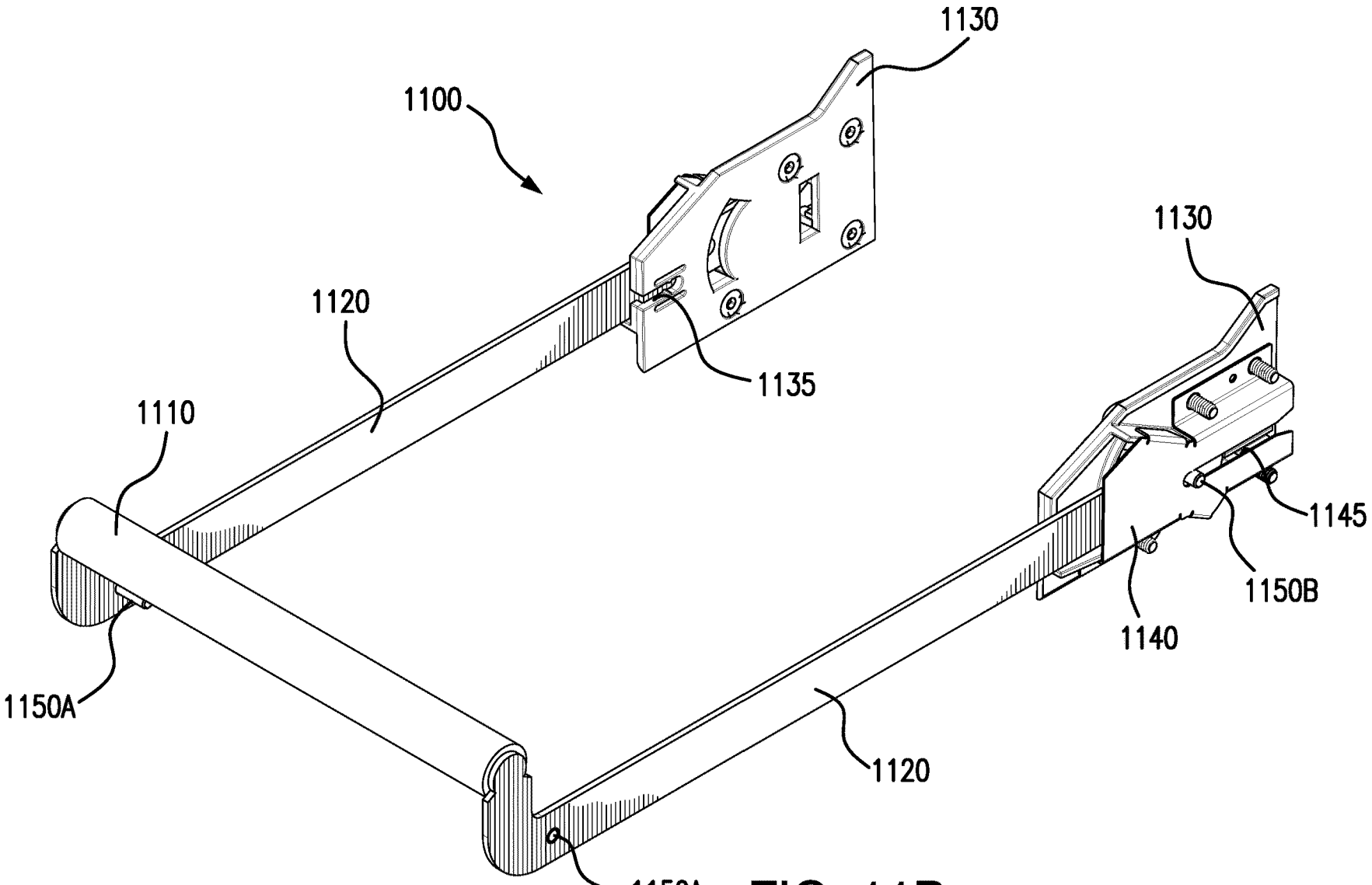

In some embodiments, water reservoir 920 is any appropriate tank, basin, container, or area within cabinet 105 to collect and hold water that is removed from airflow 101. In some embodiments, water reservoir 920 is formed using one or more walls or panels as illustrated in FIGS. 8-9 and may include a top that is at least partially open in order to allow water to collect in water reservoir 920. For example, water reservoir 920 may be located at least partially below evaporator 330 where its open top allows it to capture water falling from evaporator 330. In such embodiments, water within water reservoir 920 may collect in a corner of water reservoir 920 towards or proximate to condenser coils 310 when portable dehumidifier 100 is tilted and moved using wheels 130. This may occur, for example, in situations where the operator has not had an opportunity to fully drain water from water reservoir 920 before having to transport portable dehumidifier 100 to another location. To alleviate water from spilling out of water reservoir 920 when portable dehumidifier 100 is tilted about wheels 130, some embodiments include a compressor bracket 1010 as illustrated in FIG. 10. Compressor bracket 1010 may be attached to compressor 320 and any portion of a wall of water reservoir 920 or cabinet 105 using any appropriate fastener (e.g., screw, bolt, etc.). In general, compressor bracket 1010 covers a front and top portion of water reservoir 920 (e.g., a portion of water reservoir 920 proximate to condenser coils 310), as illustrated in order to prevent water within water reservoir 920 from spilling out of water reservoir 920 when portable dehumidifier 100 is tilted about wheels 130. In some embodiments, a lower surface of compressor bracket 1010 may include a seal or any material such as rubber in order to form a seal with water reservoir 920. Compressor bracket 1010 may have any appropriate shape and be made of any appropriate material. In some embodiments, compressor bracket 1010 is made of metal and is generally an L-shape as illustrated. The L-shape may include a first portion that attaches to compressor 320 and a second portion that may be orthogonal to the first portion and forms a water barrier or seal over a portion of water reservoir 920 as illustrated.

FIGS. 10-13 illustrate a handle mechanism 1100 that may be used by portable dehumidifier 100, according to certain embodiments. In general, handle mechanism 1100 permits handle 135 to slide into and out of cabinet 105 and to tilt upwards a certain degree so that an operator may easily transport portable dehumidifier 100 using wheels 130. Handle mechanism 1100 permits handle 135 to be retracted into cabinet 105 (FIGS. 1-2) or to be extended out of cabinet 105 (FIG. 10).

In some embodiments, handle mechanism 1100 includes a cross member 1110 and two sliding members 1120. Cross member 1110 is any appropriate shape that allows for an operator to hold cross member 1100 while transporting portable dehumidifier 100. In some embodiments, cross member 1110 includes a material suitable for gripping by an operator (e.g., a non-slip material such as rubber or foam). In some embodiments, cross member 1110 may be attached to sliding members 1120 using any appropriate fastener (e.g., screws, bolts, etc.) or may be permanently attached to sliding members 1120 using, for example, welding. Cross member 1110 and sliding members 1120 may be made of any appropriate material such as metal.

In some embodiments, handle mechanism 1100 includes bushing plates 1130 and brackets 1140. In some embodiments, bushing plates 1130 are made of plastic and brackets 1140 are made of metal. Bushing plates 1130 generally provide guides for sliding members 1120 to slide into and out of cabinet 105. Brackets 1140 attach to bushing plates 1130 and prevent sliding members 1120 from disengaging from bushing plates 1130. Brackets 1140 may be coupled to bushing plates 1130 using, for example, fasteners 1170 (e.g., bolts, screws, etc.). In some embodiments, fasteners such as fasteners 1170 also attach bushing plates 1130 to cabinet 105.

In some embodiments, sliding members 1120 include multiple pins 1150 for engaging with bushing plates 1130 and brackets 1140. For example, inward-facing front pins 1150A of sliding members 1120 engage with notches 1135 of bushing plates 1130 when handle 135 is retracted into cabinet 105. Notches 1135 and front pins 1150A provide a stop for handle 135 so that it may not be inserted too far within cabinet 105. Sliding members 1120 may also include outward-facing rear pins 1150B. Outward-facing rear pins 1150B of sliding members 1120 engage with notches 1145 of brackets 1140 when handle 135 is fully extended out of cabinet 105. Notches 1145 and rear pins 1150B provide a stop for handle 135 so that it may not be extended too far out of cabinet 105.

Figure 12:
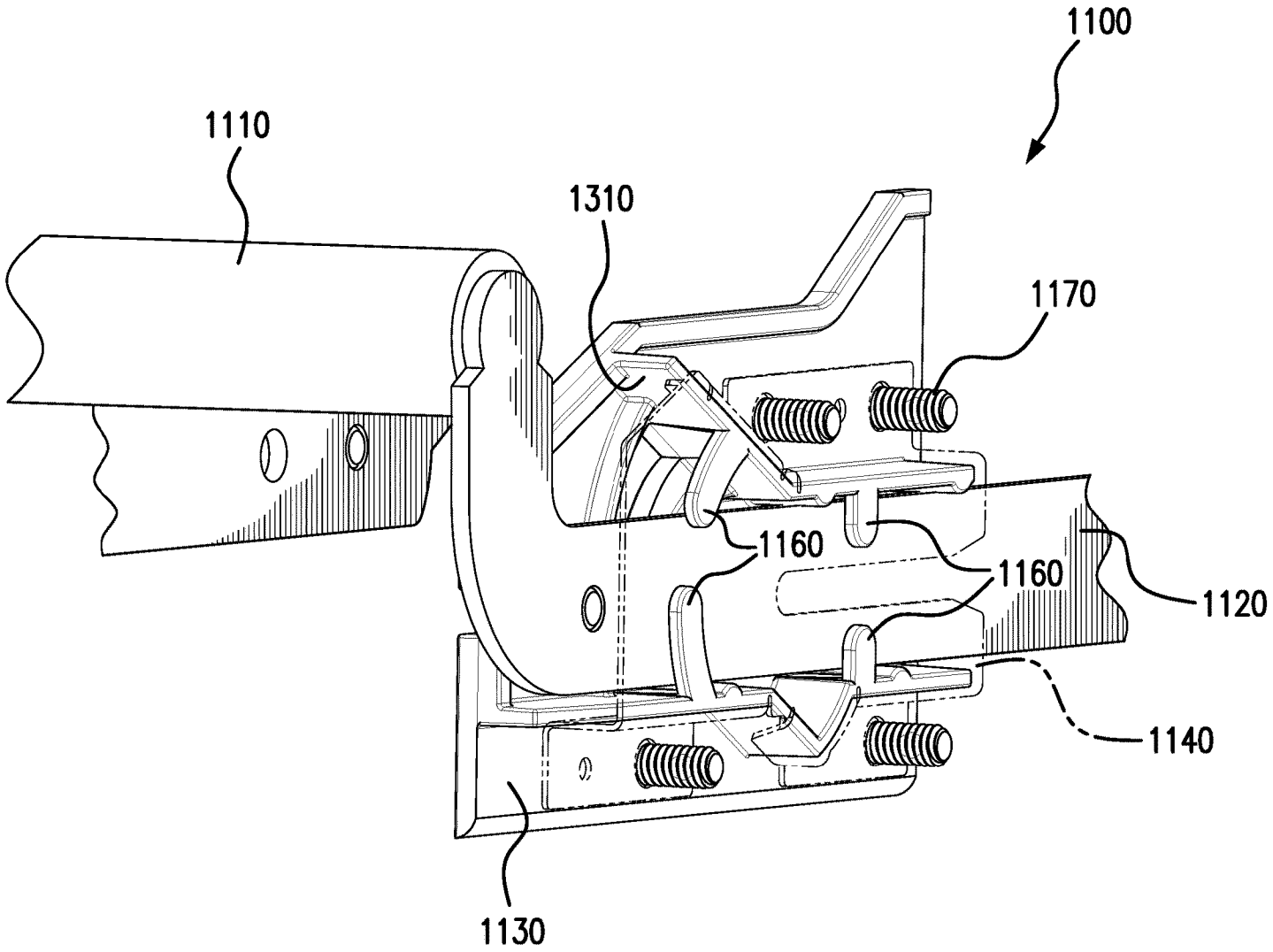

In some embodiments, bushing plates 1130 include multiple protrusions 1160 as illustrated. Protrusions 1160 generally keep sliding members 1120 engaged with bushing plates 1130 and keep them aligned within bushing plates 1130. Protrusions 1160 may be finger-shaped in some embodiments as illustrated, but may be other shapes and sizes in other embodiments. In addition, some embodiments of bushing plates 1130 may include more or fewer protrusions 1160 than illustrated. In some embodiments, bushing plates 1130 may include angled transport stops 1310 that permit handle 135 to pivot upwards when it is in its extended position. In those embodiments, bushing plates 1130 may include one or more protrusions 1160 that are positioned to provide guides for sliding members 1120 as they move into transport stops 1310. For example, as illustrated in FIGS. 12-13, bushing plates 1130 may include one protrusion 1160 that extends downward from transport stop 1310 and one protrusion 1160 that extends upwards towards transport stop 1310.

Figure 13:
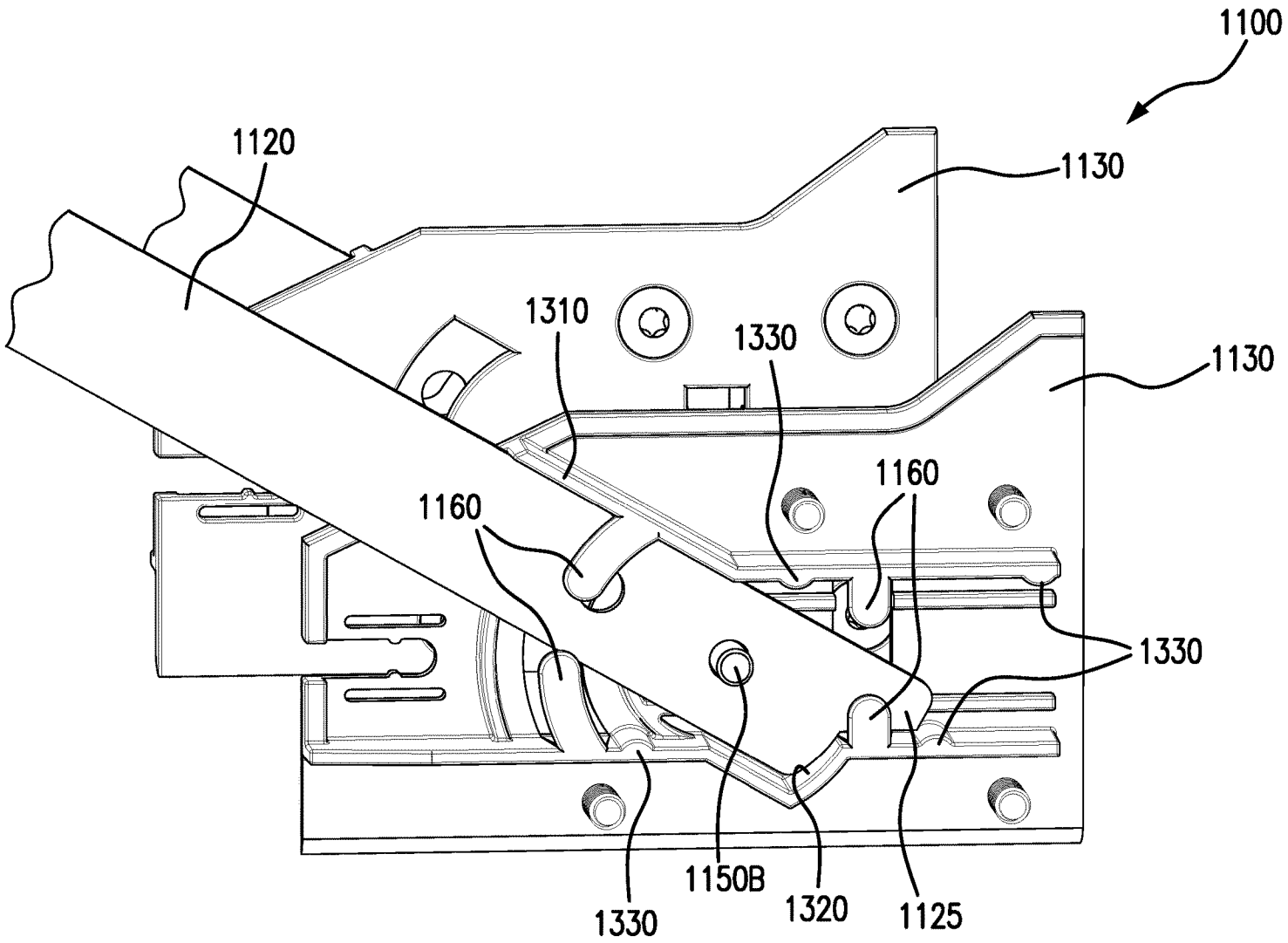

In some embodiments, bushing plates 1130 may include multiple bumps 1330 as illustrated in FIG. 13. Bumps 1330 generally contact sliding members 1120 and provide pressure and resistance on handle 135 as it slides into and out of cabinet 105. Bumps 1330 may be any shape or size, and bushing plates 1130 may include any number of bumps 1330.

As mentioned above, some embodiments of bushing plates 1130 may include transport stop 1310 that permits handle 135 to pivot upwards when it is fully extended. This may provide a more ergonomical and comfortable position for handle 135 for an operator to transport portable dehumidifier 100. In some embodiments, transport stop 1310 may be at any angle to the bottom rail of bushing plates 1130. In some embodiments, for example, the angle between transport stop 1310 and the bottom rail of bushing plates 1130 is between 25-30 degrees. This may result in handle 135 having a tilt angle with respect to level ground of between 25-30 degrees. In other embodiments, any other appropriate angle for transport stop 1310 may be used.

In some embodiments, bushing plates 1130 may include a transport lock 1320 that locks handle 135 into its tilted position as shown in FIG. 13. In such embodiments, sliding members 1120 may include an end 1125 with a shape that matches transport lock 1320 so that end 1125 fits into transport lock 1320 when handle 135 has been moved into its tilted position. This may lock handle 135 in its tilted position and prevent it from retracting back into cabinet 105. Transport lock 1320 may have any appropriate shape (e.g., a v-shaped notch), and end 1125 of sliding members 1120 may have any appropriate corresponding shape, such as that illustrated in FIG. 13.

In operation, sliding members 1120 of handle 135 slide within bushing plates 1130 along bumps 1330. Protrusions 1160 sandwich sliding members 1120 inside bushing plates 1130 and prevent sliding members 1120 from becoming disengaged with bushing plates 1130. When handle 135 has been pulled out of cabinet 105 to its fully extended position, rear pins 1150B become engaged with notches 1145 of brackets 1140. This prevents handle 135 from being extended any further and gives handle 135 a point in which to pivot handle 135. Handle 135 may then be pivoted upward until sliding members 1120 contact transport stop 1310. Once this occurs, ends 1125 of sliding members 1120 slide into transport locks 1320, thus locking handle 135 it its pivoted position. When the operator wishes to store portable dehumidifier 100, handle 135 may be disengaged from transport lock 1320 and slid back into cabinet 105 along bushing plates 1130. When handle 135 is fully retracted, pins front 1150A engage with notches 1135 of bushing plates 1130, thus preventing handle 135 from being further retracted into cabinet 105.

FIG. 14 illustrates a dehumidification system 1400 that includes dual condenser coils 310 that may be used by portable dehumidifier 100, according to certain embodiments. Dehumidification system 1400 includes two condenser coils 310: first condenser coil 310A and second condenser coil 310B. First condenser coil 310A is located closest to compressor 320 and evaporator 330, while second condenser coil 310B is located closest to fan 117 and airflow outlet 115. Second condenser coil 310B is connected to compressor 320 via a superheated vapor line 1410. First condenser coil 310A is connected to evaporator 330 via a subcooled liquid line 1430. In some embodiments, an expansion valve is included on subcooled liquid line 1430 between first condenser coil 310A and evaporator 330. First condenser coil 310A and second condenser coil 310B are connected via a condenser connection line 1420. Condenser connection line 1420 connects an output of second condenser coil 310B with an input of first condenser coil 310A. In other words, condenser coils 310 are connected in series, which provides many advantages as discussed in more detail below.

Condenser coils 310 are microchannel condensers that are made of aluminum in some embodiments. In general, microchannel condensers provide numerous features including a high heat transfer coefficient, a low air-side pressure restriction, and a compact design (compared to other solutions such as finned tub exchangers). These and other features make microchannel condensers good options for condensers in air conditioning systems where inlet air temperatures are high and airflow is high with low fan power. However, in a dehumidifier, the primary air side pressure drop occurs in the evaporator, and reducing condenser air restriction does not increase airflow significantly. Also, the air temperature upstream of the condenser is typically relatively low, often being below 60° F. The air temperature leaving the condenser is typically is over 100° F. The air temperature across the condenser typically increases over 40° F. Using this low temperature air stream efficiently is the key to a good design. In dehumidifier designs, the refrigeration system typically needs to have at least 20° F. subcooling when a finned tube condenser is used. Since a normal microchannel condenser does not provide cross counter flow, it is very difficult to get 20° F. subcooling. The weakness of micro-channel condenser (e.g., no cross counter flow) becomes significant when air temperature rises over 40° F. across the condenser. Due to this, a typical microchannel condenser is not a good condenser for a dehumidifier. To overcome these and other issues, embodiments of portable dehumidifier 100 include two condenser coils 310 connected in series as described herein. In this configuration, the pressure drop of two microchannel condenser coils 310 is still lower than that of a single finned tube coil. In addition, since a microchannel coil is thinner than a multi-row finned tube coil, the thickness of two microchannel condenser coils 310 is less than an equivalent single finned tube coil. By using two or more microchannel condenser coils 310 in series to make a cross counter flow condenser, more than 20° F. of subcooling may be achieved with a reasonable approach temperature when inlet air temperature is below 60° F. Furthermore, aluminum is typically less costly than copper, so the cost of a dual microchannel aluminum condenser is less than a single finned copper tube condenser.

In operation, refrigerant flows through dehumidification system 1400 from evaporator 330 into compressor 320, from compressor 320 into second condenser coil 310B via superheated vapor line 1410, from second condenser coil 310B into first condenser coil 310A via condenser connection line 1420, from first condenser coil 310A back to evaporator 330 (through an expansion valve in some embodiments) via subcooled liquid line 1430. The unique configuration of dehumidification system 1400 allows the refrigerant to be managed based on the direction of airflow 101 and temperature. That is, the coldest air (i.e., airflow 101 when it first hits first condenser coil 310A) subcools the liquid refrigerant within first condenser coil 310A, and the hottest air (i.e., airflow 101 when it first hits second condenser coil 310B after leaving first condenser coil 310A) de-superheats the vapor refrigerant as it passes through second condenser coil 310B.

While a particular dehumidification system 1400 has been described as having two condenser coils 310, other embodiments may have more than two condenser coils 310. For example, other embodiments of dehumidification system 1400 may have three or four condenser coils 310. In such embodiments, condenser coils 310 are connected in series using multiple condenser connection lines 1420 as described above.

FIGS. 15-16 illustrate a control panel 140 of portable dehumidifier 100, according to certain embodiments. In some embodiments, control panel 140 is located on top side 106A of cabinet 105 near airflow outlet 115. In some embodiments, control panel 140 is mounted at an angle as illustrated to allow for easy viewing of control panel 140 from a distance. In some embodiments, control panel 140 includes a display 1610, a power button 1620, a purge button 1630, a next button 1640, a set button 1650, and a status bar 1660. In some embodiments, control panel 140 may include or be communicatively coupled with a computer system 1700, as described in reference to FIG. 17 below. While a particular arrangement and quantity of these items are illustrated in FIGS. 15-16, other embodiments may have any other appropriate arrangement and quantity of these items.

In some embodiments, display 1610 is a four-line backlit LED display that provides the operator with important information about portable dehumidifier 100. For example, display 1610 may provide temperature and humidity of airflow 101 as it enters portable dehumidifier 100 (i.e., "In: 81° 28%"). This information may be obtained from sensor 510A as described above. Display 1610 may provide temperature and humidity of airflow 101 as it exits portable dehumidifier 100 (i.e., "Out: 96° 8%"). This information may be obtained from sensor 510B as described above. Display 1610 may also provide runtime and performance information (e.g., how long it has been operating, how much water is has removed, etc.) for portable dehumidifier 100 (i.e., "Hrs: 2.5 J 25.9 L"), as well as grain depression (i.e., "GD: 10 GPP"). This and other important information may be displayed on a "home" screen on control panel 140, which may be displayed at startup and at most times when portable dehumidifier 100 is operating.

In some embodiments, control panel 140 includes power button 1620 which turns portable dehumidifier 100 on and off. Control panel 140 may also include purge button 1630, which causes water pump 910 to activate and pump water out of water reservoir 920 of portable dehumidifier 100 (e.g., via drain 155). Next button 1640 and set button 1650 provide user interfaces for the user to select various options for portable dehumidifier 100. For example, the operator may select: temperature units (i.e., F or C); humidity units (e.g., relative humidity or grains); shutdown variables (e.g., after a certain amount of time, a certain temperature, a certain amount of water removed, etc.); calibration options for sensors 510; various diagnostic modes; and the like.

In some embodiments, control panel 140 includes status bar 1660 which may provide the operator a convenient and efficient way to view the status of portable dehumidifier 100 from a distance. For example, some embodiments of status bar 1660 include various LEDs or other lights that enable status bar 1660 to light up with various colors. For example, status bar 1660 may be red, blue, or green to indicate the current status or health of portable dehumidifier 100. A "green" status bar 1660 may indicate, for example, that portable dehumidifier 100 is operating normally and does not currently need attention. A "red" status bar 1660 may indicate, for example, that portable dehumidifier 100 is not operating normally and currently needs attention (e.g, water reservoir 920 is full and needs to be drained). A "blue" status bar 1660 may indicate, for example, that portable dehumidifier 100 is currently defrosting. This may allow an operator to quickly tell if any portable dehumidifier 100 needs attention. For example, an operator may place multiple portable dehumidifiers 100 in a particular room of a residence to remove water. The operator may simply walk into the room and quickly notice if any status bars 1660 are "red" in order to tell if any portable dehumidifiers 100 need attention. This saves costs by reducing the amount of time needed to monitor portable dehumidifiers 100 by operators.

Although a particular implementation of portable dehumidifier 100 is illustrated and primarily described, the present disclosure contemplates any suitable implementation of portable dehumidifier 100, according to particular needs. Moreover, although various components of portable dehumidifier 100 have been depicted as being located at particular positions, the present disclosure contemplates those components being positioned at any suitable location, according to particular needs.

FIG. 17 illustrates an example computer system 1700. In particular embodiments, one or more computer systems 1700 perform one or more steps of one or more methods described or illustrated herein. In particular embodiments, one or more computer systems 1700 provide functionality described or illustrated herein. In particular embodiments, software running on one or more computer systems 1700 performs one or more steps of one or more methods described or illustrated herein or provides functionality described or illustrated herein. Particular embodiments include one or more portions of one or more computer systems 1700. Herein, reference to a computer system may encompass a computing device, and vice versa, where appropriate. Moreover, reference to a computer system may encompass one or more computer systems, where appropriate.

This disclosure contemplates any suitable number of computer systems 1700. This disclosure contemplates computer system 1700 taking any suitable physical form. As example and not by way of limitation, computer system 1700 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 1700 may include one or more computer systems 1700; be unitary or distributed; span multiple locations; span multiple machines; span multiple data centers; or reside in a cloud, which may include one or more cloud components in one or more networks. Where appropriate, one or more computer systems 1700 may perform without substantial spatial or temporal limitation one or more steps of one or more methods described or illustrated herein. As an example and not by way of limitation, one or more computer systems 1700 may perform in real time or in batch mode one or more steps of one or more methods described or illustrated herein. One or more computer systems 1700 may perform at different times or at different locations one or more steps of one or more methods described or illustrated herein, where appropriate.

In particular embodiments, computer system 1700 includes a processor 1702, memory 1704, storage 1706, an input/output (I/O) interface 1708, a communication interface 1710, and a bus 1712. Although this disclosure describes and illustrates a particular computer system having a particular number of particular components in a particular arrangement, this disclosure contemplates any suitable computer system having any suitable number of any suitable components in any suitable arrangement.

In particular embodiments, processor 1702 includes hardware for executing instructions, such as those making up a computer program. As an example and not by way of limitation, to execute instructions, processor 1702 may retrieve (or fetch) the instructions from an internal register, an internal cache, memory 1704, or storage 1706; decode and execute them; and then write one or more results to an internal register, an internal cache, memory 1704, or storage 1706. In particular embodiments, processor 1702 may include one or more internal caches for data, instructions, or addresses. This disclosure contemplates processor 1702 including any suitable number of any suitable internal caches, where appropriate. As an example and not by way of limitation, processor 1702 may include one or more instruction caches, one or more data caches, and one or more translation lookaside buffers (TLBs). Instructions in the instruction caches may be copies of instructions in memory 1704 or storage 1706, and the instruction caches may speed up retrieval of those instructions by processor 1702. Data in the data caches may be copies of data in memory 1704 or storage 1706 for instructions executing at processor 1702 to operate on; the results of previous instructions executed at processor 1702 for access by subsequent instructions executing at processor 1702 or for writing to memory 1704 or storage 1706; or other suitable data. The data caches may speed up read or write operations by processor 1702. The TLBs may speed up virtual-address translation for processor 1702. In particular embodiments, processor 1702 may include one or more internal registers for data, instructions, or addresses. This disclosure contemplates processor 1702 including any suitable number of any suitable internal registers, where appropriate. Where appropriate, processor 1702 may include one or more arithmetic logic units (ALUs); be a multi-core processor; or include one or more processors 1702. Although this disclosure describes and illustrates a particular processor, this disclosure contemplates any suitable processor.

In particular embodiments, memory 1704 includes main memory for storing instructions for processor 1702 to execute or data for processor 1702 to operate on. As an example and not by way of limitation, computer system 1700 may load instructions from storage 1706 or another source (such as, for example, another computer system 1700) to memory 1704. Processor 1702 may then load the instructions from memory 1704 to an internal register or internal cache. To execute the instructions, processor 1702 may retrieve the instructions from the internal register or internal cache and decode them. During or after execution of the instructions, processor 1702 may write one or more results (which may be intermediate or final results) to the internal register or internal cache. Processor 1702 may then write one or more of those results to memory 1704. In particular embodiments, processor 1702 executes only instructions in one or more internal registers or internal caches or in memory 1704 (as opposed to storage 1706 or elsewhere) and operates only on data in one or more internal registers or internal caches or in memory 1704 (as opposed to storage 1706 or elsewhere). One or more memory buses (which may each include an address bus and a data bus) may couple processor 1702 to memory 1704. Bus 1712 may include one or more memory buses, as described below. In particular embodiments, one or more memory management units (MMUs) reside between processor 1702 and memory 1704 and facilitate accesses to memory 1704 requested by processor 1702. In particular embodiments, memory 1704 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 1704 may include one or more memories 1704, where appropriate. Although this disclosure describes and illustrates particular memory, this disclosure contemplates any suitable memory.

In particular embodiments, storage 1706 includes mass storage for data or instructions. As an example and not by way of limitation, storage 1706 may include a hard disk drive (HDD), a floppy disk drive, flash memory, an optical disc, a magneto-optical disc, magnetic tape, or a Universal Serial Bus (USB) drive or a combination of two or more of these. Storage 1706 may include removable or non-removable (or fixed) media, where appropriate. Storage 1706 may be internal or external to computer system 1700, where appropriate. In particular embodiments, storage 1706 is non-volatile, solid-state memory. In particular embodiments, storage 1706 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 1706 taking any suitable physical form. Storage 1706 may include one or more storage control units facilitating communication between processor 1702 and storage 1706, where appropriate. Where appropriate, storage 1706 may include one or more storages 1706. Although this disclosure describes and illustrates particular storage, this disclosure contemplates any suitable storage.

In particular embodiments, I/O interface 1708 includes hardware, software, or both, providing one or more interfaces for communication between computer system 1700 and one or more I/O devices. Computer system 1700 may include one or more of these I/O devices, where appropriate. One or more of these I/O devices may enable communication between a person and computer system 1700. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 1708 for them. Where appropriate, I/O interface 1708 may include one or more device or software drivers enabling processor 1702 to drive one or more of these I/O devices. I/O interface 1708 may include one or more I/O interfaces 1708, where appropriate. Although this disclosure describes and illustrates a particular I/O interface, this disclosure contemplates any suitable I/O interface.

In particular embodiments, communication interface 1710 includes hardware, software, or both providing one or more interfaces for communication (such as, for example, packet-based communication) between computer system 1700 and one or more other computer systems 1700 or one or more networks. As an example and not by way of limitation, communication interface 1710 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 1710 for it. As an example and not by way of limitation, computer system 1700 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 1700 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 1700 may include any suitable communication interface 1710 for any of these networks, where appropriate. Communication interface 1710 may include one or more communication interfaces 1710, where appropriate. Although this disclosure describes and illustrates a particular communication interface, this disclosure contemplates any suitable communication interface.

In particular embodiments, bus 1712 includes hardware, software, or both coupling components of computer system 1700 to each other. As an example and not by way of limitation, bus 1712 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 1712 may include one or more buses 1712, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A portable dehumidifier, comprising:

two wheels;

a cabinet comprising:

an airflow inlet located on a front side of the cabinet; and an airflow outlet located on a back side of the cabinet that is opposite the front side;

an evaporator located adjacent to the airflow inlet;

at least one microchannel condenser;

a fan located adjacent to the airflow outlet, the fan configured to generate an airflow that flows into the cabinet through the airflow inlet and out of the cabinet through the airflow outlet, the airflow flowing through the evaporator and the plurality of microchannel condensers in order to provide dehumidification to the airflow;

a compressor located within the airflow between the evaporator and the plurality of microchannel condensers;

a water reservoir located at least partially below the evaporator, the water reservoir configured to store water removed from the airflow, the water reservoir comprising a top that is at least partially open to capture water falling from the evaporator; and a bracket connected to the compressor, the bracket covering a portion of the at least partially open top of the water reservoir in order to prevent the water from spilling out of the water reservoir when the portable dehumidifier is tilted at an angle;

wherein the bracket comprises an L-shaped bracket that comprises:

a first portion that is configured to couple to the compressor; and a second portion that is orthogonal to the first portion, the second portion covering the portion of the at least partially open top of the water reservoir in order to prevent the water from spilling out of the water reservoir when the portable dehumidifier is tilted at the angle.

2. The portable dehumidifier of claim 1, further comprising a water pump located at least partially within the water reservoir, the water pump configured to pump the water out of the water reservoir.

3. The portable dehumidifier of claim 1, further comprising a drain coupled to the water reservoir.

4. The portable dehumidifier of claim 1, wherein the water reservoir is formed from one or more panels coupled to the cabinet.

5. The portable dehumidifier of claim 1, wherein the portion of the at least partially open top of the water reservoir that is covered by the bracket comprises a corner of the water reservoir proximate to the at least one microchannel condenser.

6. A portable dehumidifier, comprising:

a cabinet comprising:

an airflow inlet; and an airflow outlet;

a plurality of microchannel condensers comprising a first microchannel condenser and a second microchannel condenser;

a fan located adjacent to the airflow outlet, the fan configured to generate an airflow that flows into the cabinet through the airflow inlet and out of the cabinet through the airflow outlet, the airflow flowing through an evaporator and the plurality of microchannel condensers in order to provide dehumidification to the airflow;

a water reservoir located at least partially below the evaporator, the water reservoir configured to store water removed from the airflow, the water reservoir comprising a top that is at least partially open to capture water falling from the evaporator; and a bracket coupled to a compressor, the bracket covering a portion of the at least partially open top of the water reservoir in order to prevent the water from spilling out of the water reservoir when the portable dehumidifier is tilted at an angle;

wherein the bracket comprises an L-shaped bracket that comprises:

a first portion connected to the compressor; and a second portion that is orthogonal to the first portion, the second portion covering the portion of the at least partially open top of the water reservoir in order to prevent the water from spilling out of the water reservoir when the portable dehumidifier is tilted at the angle; and wherein the water reservoir is formed from one or more panels coupled to the cabinet.

7. The portable dehumidifier of claim 6, further comprising a water pump located at least partially within the water reservoir, the water pump configured to pump the water out of the water reservoir.

8. The portable dehumidifier of claim 6, further comprising a drain coupled to the water reservoir.

9. The portable dehumidifier of claim 6, wherein the water reservoir is formed from one or more panels coupled to the cabinet.

10. The portable dehumidifier of claim 6, wherein the portion of the at least partially open top of the water reservoir that is covered by the bracket comprises a corner of the water reservoir proximate to the at least one microchannel condenser.

11. A portable dehumidifier, comprising:

a plurality of microchannel condensers comprising a first microchannel condenser and a second microchannel condenser;

a fan located adjacent to an airflow outlet, the fan configured to generate an airflow that flows into the portable dehumidifier through an airflow inlet and out of the portable dehumidifier through the airflow outlet, the airflow flowing through an evaporator and the plurality of microchannel condensers in order to provide dehumidification to the airflow;

a water reservoir located at least partially below the evaporator, the water reservoir configured to store water removed from the airflow, the water reservoir comprising a top that is at least partially open to capture water falling from the evaporator; and a bracket coupled to a compressor, the bracket covering a portion of the at least partially open top of the water reservoir in order to prevent the water from spilling out of the water reservoir when the portable dehumidifier is tilted at an angle;

wherein the bracket comprises an L-shaped bracket that comprises:

a first portion connected to the compressor; and a second portion that is orthogonal to the first portion, the second portion covering the portion of the at least partially open top of the water reservoir in order to prevent the water from spilling out of the water reservoir when the portable dehumidifier is tilted at the angle.

12. The portable dehumidifier of claim 11, further comprising a water pump located at least partially within the water reservoir, the water pump configured to pump the water out of the water reservoir.

13. The portable dehumidifier of claim 11, wherein the water reservoir is formed from one or more panels.

14. The portable dehumidifier of claim 11, wherein the portion of the at least partially open top of the water reservoir that is covered by the bracket comprises a corner of the water reservoir proximate to the at least one microchannel condenser.

* * * * *